US007438374B2

(12) United States Patent
Shibata et al.

(10) Patent No.: US 7,438,374 B2
(45) Date of Patent: Oct. 21, 2008

(54) INKJET PRINTING APPARATUS, PRINTING CONTROL METHOD FOR INKJET PRINTING APPARATUS, PROGRAM, AND STORAGE MEDIUM

(75) Inventors: Tsuyoshi Shibata, Yokohama (JP); Hiromitsu Yamaguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/761,505

(22) Filed: Jun. 12, 2007

(65) Prior Publication Data

US 2007/0291065 A1 Dec. 20, 2007

(30) Foreign Application Priority Data

Jun. 19, 2006 (JP) ..... 2006-169380

(51) Int. Cl.
*B41J 29/38* (2006.01)

(52) U.S. Cl. ..... 347/14; 347/19; 347/15

(58) Field of Classification Search ..... 347/14, 347/15, 19

See application file for complete search history.

(56) References Cited

U.S. PATENT DOCUMENTS

| | | | |
|---|---|---|---|
| 4,313,124 A | 1/1982 | Hara | |
| 4,345,262 A | 8/1982 | Shirato et al. | |
| 4,459,600 A | 7/1984 | Sato et al. | |
| 4,463,359 A | 7/1984 | Ayata et al. | |
| 4,558,333 A | 12/1985 | Sugitani et al. | |
| 4,608,577 A | 8/1986 | Hori | |
| 4,723,129 A | 2/1988 | Endo et al. | |
| 4,740,796 A | 4/1988 | Endo et al. | |
| 5,745,132 A | 4/1998 | Hirabayashi et al. | |
| 5,751,304 A | 5/1998 | Hirabayashi et al. | |
| 5,861,895 A | 1/1999 | Tajika et al. | |
| 5,877,785 A | 3/1999 | Iwasaki et al. | |
| 5,894,314 A | 4/1999 | Tajika et al. | |
| 6,116,709 A | 9/2000 | Hirabayashi et al. | |
| 6,116,710 A | 9/2000 | Tajika et al. | |
| 6,139,125 A | 10/2000 | Otsuka et al. | |
| 6,193,344 B1 | 2/2001 | Otsuka et al. | |
| 6,310,636 B1 | 10/2001 | Tajika et al. | |
| 6,457,794 B1 | 10/2002 | Tajika et al. | |
| 6,984,011 B2 * | 1/2006 | Shimada et al. | 347/19 |

FOREIGN PATENT DOCUMENTS

| | | |
|---|---|---|
| JP | 54-56847 A | 5/1979 |
| JP | 59-123670 A | 7/1984 |
| JP | 59-138461 A | 8/1984 |

(Continued)

*Primary Examiner*—Thinh H Nguyen
(74) *Attorney, Agent, or Firm*—Fitzpatrick, Cella, Harper & Scinto

(57) ABSTRACT

This invention can perform inkjet printing operation which can reduce density irregularity and reduce deterioration in image quality without causing any deterioration in graininess. The invention relates to an image correction method or inkjet printing apparatus which divides the scanning area of a printhead into a plurality of count areas and printing areas in the scanning direction, counts the number of dots printed in each count area, and forms an image by modifying image data in the next printing area in accordance with the counted number of dots. Image data is modified by counting multilevel image data. The modified multilevel image data is converted into binary data. The binary data is then printed.

7 Claims, 26 Drawing Sheets

FOREIGN PATENT DOCUMENTS

| | | | |
|---|---|---|---|
| JP | 60-71260 | A | 4/1985 |
| JP | 5-31905 | A | 2/1993 |
| JP | 5-208505 | A | 8/1993 |
| JP | 7-125216 | A | 5/1995 |
| JP | 8-156258 | A | 6/1996 |

* cited by examiner

DROPLET SIZE : 1/1

DROPLET SIZE : 1/2

FIG. 16

1601

| | | | | | | | |
|---|---|---|---|---|---|---|---|
| 10 | 10 | 9 | 3 | 0 | 0 | 1 | 8 |
| 12 | 9 | 8 | 10 | 12 | 9 | 6 | 11 |
| 11 | 6 | 5 | 11 | 10 | 15 | 5 | 0 |
| 9 | 7 | 3 | 2 | 9 | 14 | 12 | 0 |
| 4 | 3 | 0 | 1 | 8 | 10 | 5 | 3 |
| 1 | 6 | 9 | 6 | 11 | 9 | 8 | 2 |
| 0 | 4 | 8 | 5 | 0 | 0 | 1 | 5 |
| 0 | 1 | 8 | 9 | 7 | 3 | 2 | 4 |

300dpi × 300dpi

64 PIXELS (4 BITS)

ACCUMULATED TONE VALUE : 380

TOTAL NUMBER OF DOTS : 380

FIG. 18

BEFORE DATA MODIFICATION

| | | | | | | | |
|---|---|---|---|---|---|---|---|
| 10 | 10 | 9 | 3 | 0 | 0 | 1 | 8 |
| 12 | 9 | 8 | 10 | 12 | 9 | 6 | 11 |
| 11 | 6 | 5 | 11 | 10 | 15 | 5 | 0 |
| 9 | 7 | 3 | 2 | 9 | 14 | 12 | 0 |
| ⋮ | | | | | | ⋮ | |
| 0 | 4 | 8 | 5 | 0 | 0 | 1 | 5 |
| 0 | 1 | 8 | 9 | 7 | 3 | 2 | 4 |

1801

300dpi × 300dpi 7,680 PIXELS (4BITS)

ACCUMULATED TONE VALUE : 3000

1802

THRESHOLD MATRIX MASK

| | | | | | | | |
|---|---|---|---|---|---|---|---|
| 1250 | 2891 | 3698 | 1849 | 6883 | 304 | 1 | 864 |
| 1834 | 87 | 5827 | 944 | 687 | 5510 | 4013 | 25 |
| 7620 | 794 | 3453 | 91 | 4287 | 7080 | 1462 | 157 |
| 84 | 3015 | 345 | 6531 | 190 | 2258 | 2443 | 759 |
| ⋮ | | | | | | ⋮ | |
| 7036 | 3827 | 519 | 2981 | 0 | 286 | 627 | 6094 |
| 2 | 1174 | 846 | 6601 | 3548 | 67 | 1524 | 45 |

CORRECTION AMOUNT : 300

AFTER DATA MODIFICATION

| | | | | | | | |
|---|---|---|---|---|---|---|---|
| 10 | 10 | 9 | 3 | 0 | 0 | 1 | 8 |
| 12 | (8) | 8 | 10 | 12 | 9 | 6 | (10) |
| 11 | 6 | 5 | (10) | 10 | 15 | 5 | 0 |
| (8) | 7 | 3 | 2 | (8) | 14 | 12 | 0 |
| ⋮ | | | | | | ⋮ | |
| 0 | 4 | 8 | 5 | 0 | 0 | 1 | 5 |
| 0 | 1 | 8 | 9 | 7 | (2) | 2 | (3) |

1803

300dpi × 300dpi 7,680 PIXELS (4BITS)

ACCUMULATED TONE VALUE : 2700

FIG. 25

BEFORE DATA MODIFICATION

| | | | | | | | |
|---|---|---|---|---|---|---|---|
| 10 | 10 | 9 | 3 | 0 | 0 | 1 | 8 |
| 12 | 9 | 8 | 10 | 12 | 9 | 6 | 11 |
| 11 | 6 | 5 | 11 | 10 | 15 | 5 | 10 |
| 9 | 7 | 8 | 2 | 9 | 14 | 12 | 8 |
| 0 | 4 | 8 | 5 | 0 | 0 | 1 | 5 |
| 0 | 1 | 8 | 15 | 7 | 3 | 2 | 4 |

2501

300dpi × 300dpi 7,680 PIXELS (4BITS)

ACCUMULATED TONE VALUE : 40000

CORRECTION AMOUNT : 9000

THRESHOLD MATRIX MASK

2502

| | | | | | | | |
|---|---|---|---|---|---|---|---|
| 1250 | 2891 | 3698 | 1849 | 6883 | 304 | 1 | 864 |
| 1834 | 87 | 5827 | 944 | 687 | 5510 | 4013 | 25 |
| 7620 | 794 | 3453 | 91 | 4287 | 7080 | 1462 | 157 |
| 84 | 3015 | 345 | 6531 | 190 | 2258 | 2443 | 759 |
| 7036 | 3827 | 519 | 2981 | 0 | 286 | 627 | 6094 |
| 2 | 1174 | 846 | 6601 | 3548 | 67 | 1524 | 45 |

AFTER DATA MODIFICATION

| | | | | | | | |
|---|---|---|---|---|---|---|---|
| (8) | 9 | 8 | 2 | (0) | 0 | 0 | (6) |
| 11 | (7) | 7 | (8) | (10) | 8 | 5 | (9) |
| 10 | (4) | 4 | (9) | 9 | 14 | 4 | (8) |
| 8 | 6 | 7 | 1 | (7) | 13 | 11 | (6) |
| 0 | 3 | (6) | 4 | 0 | 0 | 0 | 4 |
| 0 | 0 | (6) | 14 | 6 | (1) | 1 | (2) |

2503

300dpi × 300dpi 7,680 PIXELS (4BITS)

ACCUMULATED TONE VALUE : 31000

INKJET PRINTING APPARATUS, PRINTING CONTROL METHOD FOR INKJET PRINTING APPARATUS, PROGRAM, AND STORAGE MEDIUM

BACKGROUND OF THE INVENTION

1. Field of the Invention

The present invention relates to an inkjet printing apparatus, a printing control method for the inkjet printing apparatus, a program, and a storage medium and, more particularly, to an inkjet printing apparatus which prints by reciprocally scanning an inkjet printhead and performing reciprocal printing on a printing medium such as printing paper, a printing control method for the inkjet printing apparatus, a program, and a storage medium.

2. Description of the Related Art

A printing apparatus is used as a printing unit for images in a printer, a copying machine, or a facsimile apparatus, or as an output device for a multi-functional peripheral including a computer, a word processor, a workstation, or the like. This printing apparatus is configured to print image information such as characters and images on a printing material (to be also referred to as a printing medium hereinafter) such as printing paper, a thin plastic plate, or the like on the basis of image information (including all output information such as character information).

Such printing apparatuses can be classified into an inkjet system, wire dot system, thermal system, laser beam system, and the like according to the printing method. Of these systems a printing apparatus based on the inkjet system (to be referred to as an inkjet printing apparatus hereinafter) prints by discharging ink from a printing unit including a printhead onto a printing medium. This system therefore have various advantages as compared with the remaining printing systems, for example, higher resolution, higher speed, quietness, and lower cost. On the other hand, recently, with an increase in the importance of color outputs such as color images, many color inkjet printing apparatuses with high image quality equivalent to silver halide photographs have been developed and are commercially available.

Such an inkjet printing apparatus uses a printhead obtained by integrating a plurality of ink discharge apertures and fluid channels as a printhead on which a plurality of printing elements are integrated and arrayed to increase the printing speed. In addition, in order to cope with color printing, an inkjet printing apparatus is generally used, which comprises a plurality of printheads each obtained by integrating a plurality of ink discharge apertures and fluid channels.

Although various systems are known as printing systems for printers, the inkjet system, in particular, has attracted attention because, for example, it can perform noncontact printing on a printing medium such as printing paper, easily allows for color printing, and is very quiet in quietness. In general, a serial printing system is widely used because it has low cost and is compact. This system uses a printhead which discharges ink in accordance with printing information to be printed and performs printing while reciprocally scanning the printhead in a direction perpendicular to the feeding direction of a printing medium such as printing paper.

Recently, such inkjet printing apparatuses have greatly improved in performance, and have been achieving high printing speeds almost as high as those of laser beam printers. In addition, with an increase in the processing speed of personal computers and the proliferation of the Internet, demand has arisen for an increase in printing speed for color images.

Furthermore, there has recently been strong demand for an improvement in the quality of printed images in addition to an increase in printing speed. In order to simultaneously satisfy these requirements, there has been developed a printing apparatus which can print images with high resolution by using a printhead which has achieved a further reduction in ink droplet size and an increase in nozzle density.

In addition, with the demand for an improvement in the image quality of an inkjet printing apparatus, a printhead having nozzles capable of discharging droplets in different ink discharge amounts has been under development in order to perform tone representation with higher resolution. There has already been commercially available an inkjet printing apparatus which can perform smooth tone representation by reproducing ink droplet sizes of different dot sizes (for example, large and small dots) on printing paper.

Of the inkjet systems, an air bubble jet printing system (BJ system) is designed to discharge ink droplets from orifices with the pressure of air bubbles generated by abruptly heating and vaporizing ink using heating elements. The air bubbles generated by the printhead of the bubble jet system having this structure are cooled by the surrounding ink, and ink vapor in the air bubbles condenses and returns to the liquid. As a consequence, the air bubbles disappear. On the other hand, the ink consumed by discharging is replenished from ink storing in ink tanks through ink supply paths.

FIG. 1A is a view showing an example of the arrangement of the nozzles (discharge apertures) of an inkjet printhead 101, which has a plurality of nozzle arrays 102 so as to discharge different kinds of inks. As shown in FIG. 1B, each nozzle array 102 is configured such that a discharge aperture array 103L with a large amount of ink discharge is placed on the left side of an ink supply path 105, and a discharge aperture array 103S with a small amount of ink discharge is placed on the right side of the ink supply path 105. Using the respective discharge aperture arrays makes it possible to print large and small dots on printing paper. Ink is supplied from the ink supply path 105 through ink flow paths 104 provided in correspondence with the nozzle arrays 103L and 103S.

The printhead 101 shown in FIG. 1A is used for color printing, and is configured such that two pairs of nozzle arrays, each having a combination of nozzles with large and small ink discharge amounts, are respectively arranged on the left and right sides (a total of four arrays for two colors), and two nozzle arrays, each having a combination of nozzles with the same ink discharge amount, are arranged in the middle. With this arrangement, the printhead 101 can perform color printing by symmetrically discharging cyan (C) ink and magenta (M) ink and discharging yellow (Y) ink and black (BK) ink in the middle.

FIG. 2 shows the arrangement of the main part of the inkjet printing apparatus for printing on printing paper P by using the inkjet printhead 101 shown in FIGS. 1A and 1B (this operation will also be referred to as printing hereinafter) Referring to FIG. 2, reference numeral 201 denotes an inkjet cartridge (printing unit). These inkjet cartridges 201 comprise ink tanks for ink in four colors and printheads. That is, the inkjet cartridges 201 comprise ink tanks respectively storing black (BK), cyan (C), magenta (M), and yellow (Y) inks and the printheads 101 corresponding to the respective inks.

Reference numeral 203 denotes a paper feed roller (subs-scanning unit), which rotates in the direction indicated by the arrow in FIG. 2 while clamping the printing paper P together with an auxiliary roller 204, thereby intermittently conveying the printing paper P in the Y direction. Reference numeral 205 denotes a pair of feed rollers which feeds the printing paper P.

The pair of feed rollers 205 rotates while clamping the printing paper P, like the rollers 203 and 204, but rotates at a rotational speed lower than that of the paper feed roller 203 to produce tension on the printing paper P. This makes it possible to convey the printing paper P without any flexure.

Reference numeral 206 denotes a carriage (main scanning unit) which reciprocally moves (or reciprocally scans) in the main scanning direction (the X direction in FIG. 2) perpendicular to the Y direction while supporting the four inkjet cartridges 201. The carriage 206 stands by at a home position h indicated by the broken line in FIG. 2 while the printhead 101 performs no printing operation or during a recovery process for the printhead 101.

Upon receiving a print start command, the carriage 206 located at the home position h before the start of printing performs printing with a width of N/1200 inches on the printing paper P by using N (N is an arbitrary positive integer) nozzles of the printhead 101 while scanning in the X direction in FIG. 2. Upon completion of printing to an end portion of the printing paper P, the carriage returns to the home position h, and scans again to print in the X direction. Before the start of the second printing operation after the completion of the first printing operation, the paper feed roller 203 rotates in the direction indicated by the arrow to feed the printing paper P in the Y direction by a width of N/1200 inches.

In this manner, the printhead 101 repeatedly performs printing operation with a width of N/1200 inches and paper feeding operation for every scanning by the carriage 206, thereby completing printing of an image signal corresponding to, for example, one page on the printing paper P. Note that the printing mode of completing printing within the same area by one scanning operation of the carriage 206 will be referred to as a 1-pass printing mode.

As another printing mode used for the inkjet printing apparatus, a multi-pass printing mode is available. The multi-pass printing mode is the printing mode of completing printing within the same printing area by overprinting a plurality of times in the printing area. It is generally known that in the multi-pass printing mode, a larger the number of passes results in a better image quality.

Note that FIG. 2 shows uni-directional scanning/printing operation of performing printing operation only at the time of forward scan of the carriage 206. However, when printing at a higher speed, the printing apparatus generally uses a bi-directional scanning/printing system of printing both at the time of forward scan and at the time of backward scan of the carriage 206.

It is known that when images are to be formed by using the inkjet printing system, continuously applying identical driving pulses to heating elements will cause density irregularity due to a rise in the temperature of the head which is caused by continuous heating by heaters. This density irregularity will be described in detail later.

For this reason, when performing high-image-quality printing in the inkjet printing system, it is important to reduce this density irregularity. As a method of reducing density irregularity, there is generally proposed a unit which uniformly controls discharge amounts or a unit which corrects printing data. Other known techniques of reducing density irregularity include a technique using the above multi-pass printing mode and a technique of setting the scanning speed to a relatively low speed although it has a demerit that the printing speed decreases.

The ink discharge amount of the printhead 101 depends on the temperature of the ink near each heating element when identical driving pulses are to be applied to the heating element. It is therefore necessary to manage the temperature of ink. It is, however, practically difficult to manage the temperature of ink, and hence a technique of controlling the ink discharge amount of the printhead 101 by managing the temperature of the printhead 101 instead of the temperature of ink is in widespread use.

For example, Japanese Patent Laid-Open No. 5-31905 discloses a technique of arranging a sensor for detecting the temperature of a printhead in the printhead and monitoring an output from the sensor by using an MPU (CPU) as a detection unit. There is also proposed a control method (PWM control) of shortening the heating time of a heater to suppress a rise in the temperature of the printhead by changing the pulse width of a pulse signal for heater driving when the temperature rises, thereby making the ink discharge amounts constant.

The sensor is, however, attached near the printhead, and hence the MPU (CPU) cannot monitor an accurate output due to noise caused by the driving of the printhead. This makes it impossible to perform accurate temperature control and to sufficiently control the ink discharge amount.

To cope with this problem, there is also a proposal of using a mechanism for amplifying a detected temperature output, a technique of taking countermeasures against noise in a detection result, and the like as well as providing the temperature sensor for the printhead. However, such a proposal leads to an increase in cost. For this reason, there has been proposed a technique of estimating the temperature of the printhead from image data to be printed in consideration of the reliability of the temperature sensor, and there has been a proposal using this technique in place of or together with the above technique.

For example, as a technique of estimating a temperature from printing data, there is known a technique of temporarily storing image data corresponding to one main scan in a memory area such as an image buffer before the execution of the next printing/scanning operation, and then estimating a head temperature from a count result obtained by counting the number of effective data in the image buffer, thereby modifying the driving condition for the head on the basis of the estimated temperature.

For example, Japanese Patent Laid-Open Nos. 5-208505 and 7-125216 disclose a technique of estimating a fluctuation in the temperature of an inkjet head from the amount of heat charged to the inkjet head per unit time, and modifying the width of a driving pulse on the basis of the estimation result.

Recently, with an increase in discharge frequency accompanying an increase in printing speed and with an increase in the number of nozzles per nozzle array, strong demand has arisen for the use of a technique higher in accuracy than the conventional temperature estimation method.

Shortening the time interval of temperature estimating calculation can achieve an increase in the accuracy of estimation of the temperature of the inkjet head. However, shortening the calculation time interval will increase the load of calculation on the main body of the printing apparatus. This will lead to the necessity of improving the performance of an MPU (CPU) as a calculating unit or a decrease in throughput.

In order to cope with this problem, Japanese Patent Laid-Open No. 7-125216 discloses, as a method of estimating a temperature with high accuracy and with a low calculation load from a driving condition for a printhead, a technique of estimating the temperature of the printhead and accurately controlling an ink discharge amount by executing the above PWM control in accordance with the estimated temperature.

More specifically, this technique converts the driving condition for the printhead into the amount of heat charged and accumulated in the printhead, and calculates the amount of heat accumulated after heat dissipation with the lapse of a unit time from the amount of heat accumulated in the inkjet head by the time of the previous printing/scanning operation. The technique then stores the amount of heat accumulated in the printhead for each thermal time constant, and adds each amount of heat charged to the amount of heat after heat dissipation, thereby calculating a rise in the temperature of the printhead.

Japanese Patent Laid-Open No. 8-156258 discloses a technique which is designed especially for large printing apparatuses and to estimate a temperature from image data in real time and perform discharge amount control. That is, this reference discloses a technique of counting effective data in image data, and when the count value reaches a predetermined value, modifying the width of a head driving pulse signal, or a technique of performing data correction by thinning printing data by a predetermined amount.

Consider an inkjet printing apparatus having a printhead including discharge apertures with different discharge amounts to print dots with different dot sizes on the printing paper P as described above. In this case, owing to demand for high image quality, even an apparatus with a discharge amount for a large size is required to discharge very small droplets in practice in consideration of image quality, more specifically, graininess. For example, an apparatus with about 5 pl as a large ink discharge amount and an apparatus with about 2 pl as a small ink discharge amount are on the market. The ink droplet sizes of these apparatuses are much smaller than those some years ago. In order to achieve a further improvement in image quality, it is required to further reduce the ink droplet size. When printing is to be performed by using such a printhead with a small ink discharge amount, the number of ink dots covering a printing area influences the size of the printing area.

When dots with a small ink discharge amount about half that in the case shown in FIG. 3A are to be used, the number of dots to be arranged to print in the same printing area with the same density needs to be twice in the vertical and horizontal directions, that is, four times that in the prior art as a whole, as shown in FIG. 3B. Obviously, if the number of nozzles and nozzle density of the printhead and the discharge frequency remain the same, the printing speed greatly decreases.

In order to maintain the printing speed almost equal to that in the prior art by using such a printhead with a small droplet size, there have proposed means for improving the performance of the printhead itself. These means include a method of increasing the printing width by increasing the number of nozzles and a method of increasing the discharge frequency of ink droplets. In addition, it is required to improve an image forming method by, for example, shortening the printing time in a printing area to increase the printing speed for each main scanning operation, and decreasing the number of passes in multi-pass printing operation.

Increasing the ink discharge frequency of a printhead will shorten the printing time required for one scan. This, however, increases the temperature of the printhead accompanying ink discharge during a scan and leads to an increase in ink discharge amount due to an operation error. In addition, an increase in the number of ink dots to be printed in a printing area owing to a reduction in droplet size will lead to a further rise in the temperature of the printhead and an increase in ink discharge amount errors. For this reason, the degree of rise in head temperature during one printing/scanning operation further increases. As a result, a further increase in ink discharge amount causes density irregularity in the printing area for each scan.

In addition, when high-speed printing is to be performed with the decreased number of printing passes in the multi-pass printing system, the number of ink dots to be discharged per scan increases with an increase in the number of passes. In this case as well, an increase in ink discharge amount owing to a rise in the temperature of the printhead will cause density irregularity in the printing area. Obviously, simultaneously increasing the ink discharge speed and the number of passes will have a very significant influence.

On the other hand, as the printing speed increases, the detection of a head temperature by a temperature sensor lacks in performance in terms of responsiveness. In addition, in detection by a unit which estimates a temperature from printing data, an increase in discharge frequency will decrease the maximum pulse width within one discharge timing. This narrows the controllable range of ink discharge amounts in the changeable range of pulse widths. That is, the control performance is not currently sufficient.

When a bi-directional printing system is used to print by high-speed ink discharging operation in the above 1-pass printing mode, the entire area printed for each scan has a density distribution in the main scanning direction. More specifically, as shown in FIG. 5, density irregularity occurs in the form of a band for each scan. This density irregularity is especially noticeable on the two end portions of the printing area.

FIGS. 6A to 6D are a view showing the state (FIG. 6A) of a printing area when a solid image with the same tone is printed by an arbitrary main scan in the above 1-pass printing mode, and graphs showing the relationship between the temperature of the inkjet printhead 101 and the ink discharge amount at that time.

Referring to FIGS. 6A to 6D, the head temperature rises in the process of printing operation in the main scanning direction of the printhead 101 as shown in FIG. 6B. With this rise in temperature, the ink discharge amount increases as shown in FIGS. 6C to 6D in both the case of nozzles (discharge apertures) with a small ink discharge amount and the case of nozzles (discharge apertures) with a large ink discharge amount. As a result, density irregularity occurs in the main scanning direction, as shown in FIG. 6A.

As described above, when a printhead comprises nozzles (discharge apertures) with different ink discharge amounts, the ink discharge amounts of the respective types of nozzles increase in different manners. In addition, if tone reproduction is performed with a combination of large dots formed by droplets with a large discharge amount and small dots formed by droplets with a small discharge amount, the density increases due to the influences of the respective ink discharge amounts.

In accordance with a rise in density in the process of printing/scanning operation, therefore, it is necessary to decrease the discharge amount of ink to print. For example, there is proposed a method of executing density correction in accordance with a rise in temperature while counting the dots of image data to be printed.

More specifically, the scanning area of the inkjet printhead 101 is divided into a plurality of count areas and printing areas in the scanning direction. This method then counts the number of dots printed in a count area and modifies image data in the next printing area in accordance with the counted number of dots, thereby forming an image. To modify the image data is to modify the data upon counting multi-tone image data, convert the modified multi-tone image data into binary data, and print it.

This method allows a decrease in the number of dots to be printed as the temperature of the printhead 101 rises and a reduction in density irregularity.

However, independently correcting the image data respectively formed by large dots and small dots discharged from nozzles (discharge apertures) with different ink discharge amounts will make the corrected positions overlap and will reduce the image data more than necessary. As a result, as shown on the right side of FIG. 4A, noticeably lightly printed portions "excessive bright portions" 401 appear only in the corresponding portions. That is, although the density irregularity is reduced, graininess may deteriorate.

SUMMARY OF THE INVENTION

The present invention proposes an inkjet printing method which prints an image by discharging droplets of different ink discharge amounts. That is, the present invention proposes a correction method of suppressing an increase in density due to an increase in ink discharge amount with a rise in the temperature of a printhead 101 upon reception of the influence of ink discharge when high-speed printing is to be performed.

That is, it is an object of the present invention to provide an inkjet printing system which can reduce density irregularity and reduce deterioration in image quality without causing any deterioration in graininess even in an inkjet system which forms an image by discharging inks of different ink discharge amounts.

In order to achieve the above object, an embodiment of the present invention provides a printing apparatus which prints a dot image on a printing medium by scanning a printhead configured to print a first dot and a second dot smaller than the first dot, the apparatus comprising:

an obtaining unit configured to obtain, for each of areas formed by dividing an area on the printing medium into a plurality of portions, tone value information of first dot multilevel image data corresponding to a plurality of pixels constituting the area and tone value information of second dot multilevel image data corresponding to the plurality of pixels constituting the area; and a correcting unit configured to correct the first dot multilevel image data on the basis of the obtained tone value information of the first dot multilevel image data and to correct the second dot multilevel image data on the basis of the obtained tone value information of the second dot multilevel image data, wherein the correcting unit exclusively determines correction target pixel positions of the first dot multilevel image data and correction target pixel positions of the second dot multilevel image data.

In order to achieve the above object, another embodiment of the present invention provides a printing apparatus which prints a dot image on a printing medium by scanning a printhead configured to print a first dot and a second dot higher in lightness than the first dot, the apparatus comprising: an obtaining unit configured to obtain, for each of areas formed by dividing an area on the printing medium into a plurality of portions, tone value information of first dot multilevel image data corresponding to a plurality of pixels constituting the area and tone value information of second dot multilevel image data corresponding to the plurality of pixels constituting the area; and a correcting unit configured to correct the first dot multilevel image data on the basis of the obtained tone value information of the first dot multilevel image data and to correct the second dot multilevel image data on the basis of the obtained tone value information of the second dot multilevel image data, wherein the correcting unit exclusively determines correction target pixel positions of the first dot multilevel image data and correction target pixel positions of the second dot multilevel image data.

In order to achieve the above object, still another embodiment of the present invention provides a method of controlling a printing apparatus which prints a dot image on a printing medium by scanning a printhead configured to print a first dot and a second dot smaller than the first dot, the method comprising the steps of: obtaining, for each of areas formed by dividing an area on the printing medium into a plurality of portions, tone value information of first dot multilevel image data corresponding to a plurality of pixels constituting the area and tone value information of second dot multilevel image data corresponding to the plurality of pixels constituting the area; and correcting the first dot multilevel image data on the basis of the obtained tone value information of the first dot multilevel image data and correcting the second dot multilevel image data on the basis of the obtained tone value information of the second dot multilevel image data, wherein the correcting step exclusively determines correction target pixel positions of the first dot multilevel image data and correction target pixel positions of the second dot multilevel image data.

In order to achieve the above object, still another embodiment of the present invention provides a program for causing a computer to execute a procedure of a printing control method for an inkjet printing apparatus defined in the above embodiment.

In order to achieve the above object, still another embodiment of the present invention provides a computer-readable storage medium storing a program for causing a computer to execute a procedure of a printing control method for an inkjet printing apparatus defined in the above embodiment.

According to the present invention, it is possible to perform inkjet printing which can reduce density irregularity and reduce deterioration in image quality without causing any deterioration in graininess even in an inkjet system which forms an image by discharging inks in different ink discharge amounts.

Further features of the present invention will become apparent from the following description of exemplary embodiments with reference to the attached drawings.

BRIEF DESCRIPTION OF THE DRAWINGS

FIG. 16 is a view schematically showing multilevel input image data equivalent to data in an arbitrary area of printing data in an embodiment of the present invention;

FIG. 18 is a view schematically showing the processing of modifying the tone values of input image data in accordance with the numerical order of a threshold matrix in an embodiment of the present invention;

FIG. 25 is a view schematically showing the processing of modifying the tone values of input image data in accordance with the numerical order of a threshold matrix in an embodiment of the present invention.

DESCRIPTION OF THE EMBODIMENTS

Figure 2:
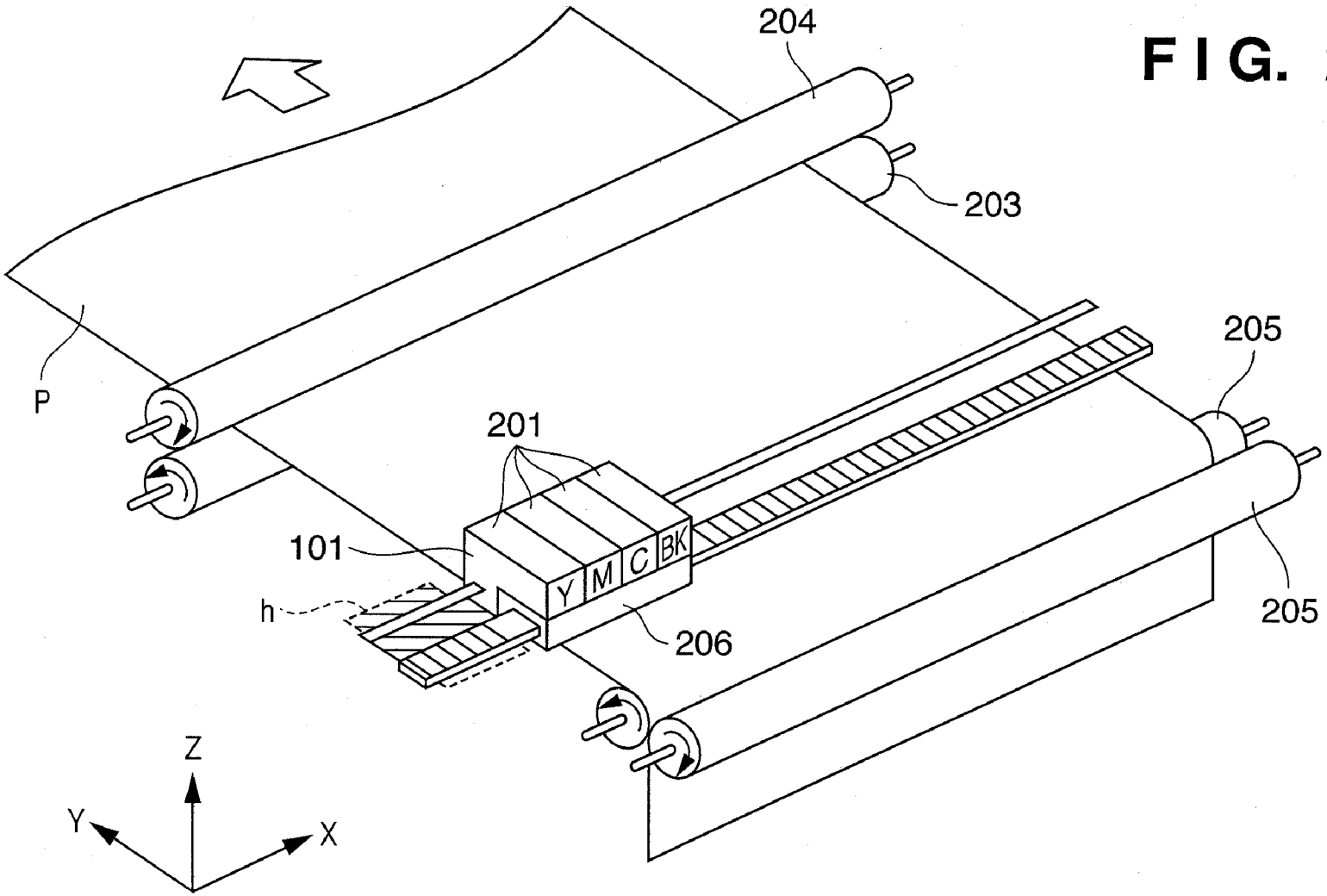
FIG. 2 is a perspective view showing the arrangement of the main part of a printing apparatus which can be used in an embodiment of the present invention and prints on printing paper by using a printhead.
Figure 3A:
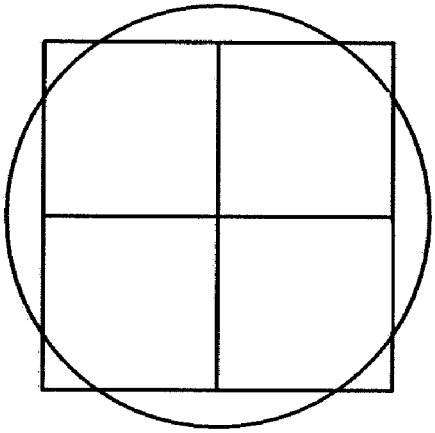
FIGS. 3A and 3B are views for explaining the number of ink dots to cover a printing area based on a droplet size in an embodiment of the present invention.
Figure 3B:
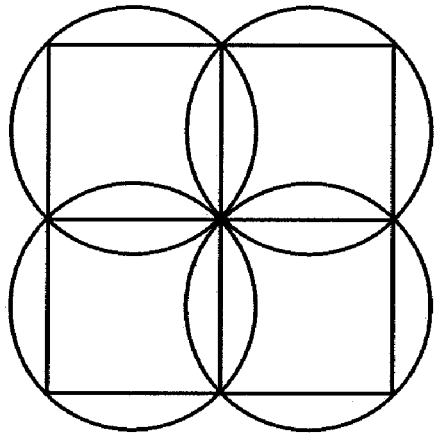
Figure 7:
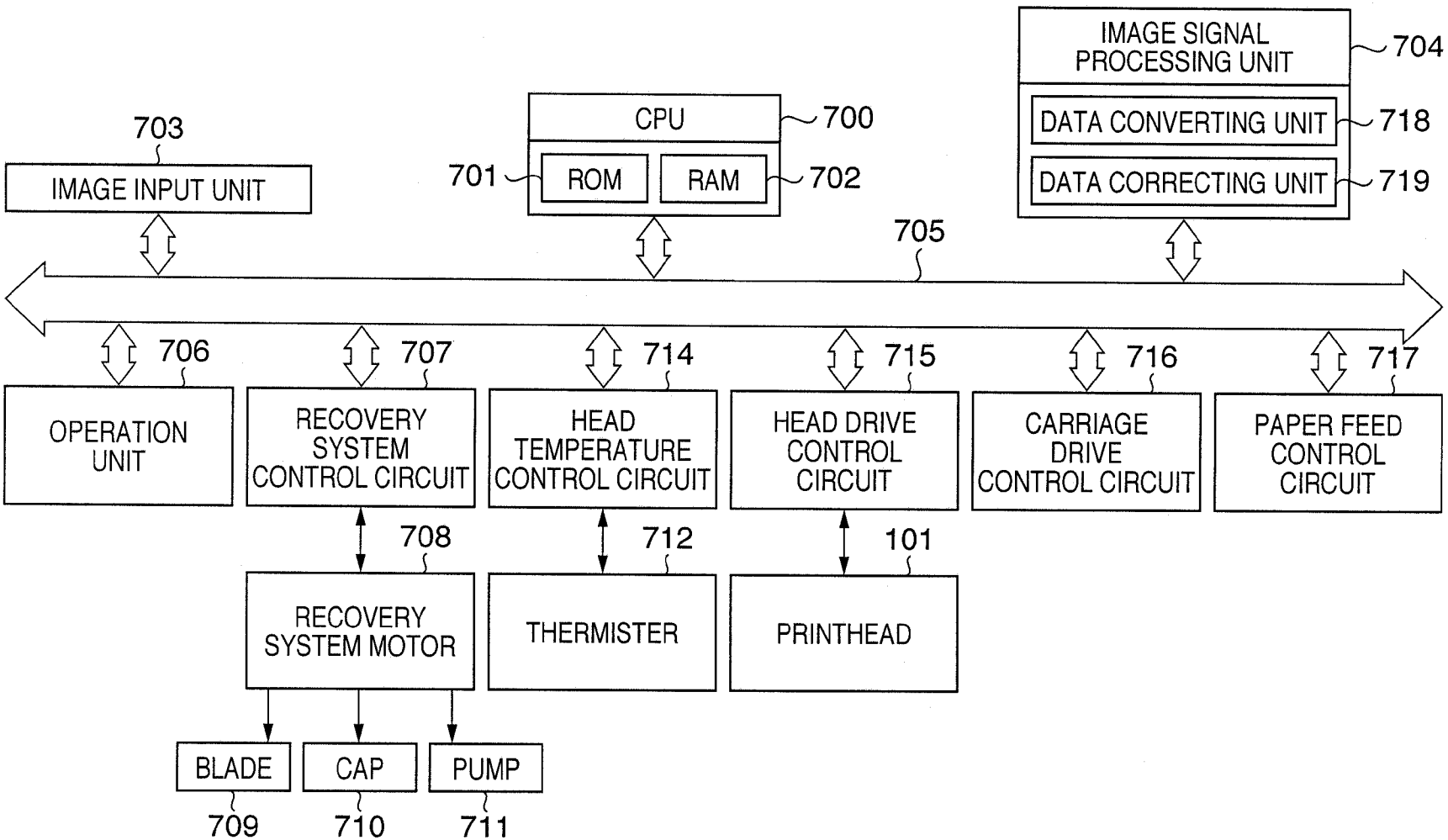
FIG. 7 is a block diagram showing a control arrangement for an inkjet printing apparatus in an embodiment of the present invention.

FIG. 7 is a block diagram showing the control arrangement of an inkjet printing apparatus according to an embodiment of the present invention. Note that the arrangement of the mechanical part of the inkjet printing apparatus according to this embodiment has a structure similar to that shown in FIG. 2.

Referring to FIG. 7, a CPU 700 executes control and data processing in each unit of the apparatus through a main bus line 705. That is, the CPU 700 performs control and data processing in each unit (to be described later) including a head drive control circuit 715 and a carriage drive control circuit 716 in accordance with the programs stored in a ROM 701. A RAM 702 is also used as a work area for data processing and the like performed by the CPU 700.

In addition, a hard disk or the like sometimes is connected, as another storage device, to the CPU 700 via the main bus line 705, as needed. An image input unit 703 includes an interface with a host apparatus, and temporarily stores image data input from the host apparatus. An image signal processing unit 704 comprises a data converting unit 718 which performs color conversion, binarization, a mask process, and the like, and a data correcting unit 719 which executes various kinds of data processing. An operation unit 706 comprises keys, a mouse, and the like, which allow the user to perform control input and the like. A recovery system control circuit 707 controls recovery operation such as preliminary discharge in accordance with the recovery process program stored in the RAM 702. A recovery system motor 708 drives a printhead 101 (identical to that shown in FIGS. 1A and 1B), a blade 709 which faces or separates from the printhead 101, a cap 710, a pump 711 for suction, and the like. The head drive control circuit 715 controls the driving of electrothermal transducers for ink discharge in the printhead 101 to cause the printhead 101 to discharge ink for preliminary discharge or printing. In addition, the carriage drive control circuit 716 and a paper feed control circuit 717 respectively control the movement of a carriage 206 and paper feed in accordance with control programs. A board on which the ink discharging electrothermal transducers of the printhead 101 are mounted includes heat insulation heaters, and can raise and adjust the ink temperature in the printhead 101 to a desired set temperature. A thermister 712 is also mounted on the board and is used to measure the actual temperature of ink in the printhead 101. The thermister 712 may also be provided outside the board or near the printhead 101.

The operation of each embodiment of the present invention will be described in detail below on the basis of the above apparatus arrangement.

First Embodiment

Figure 1A:
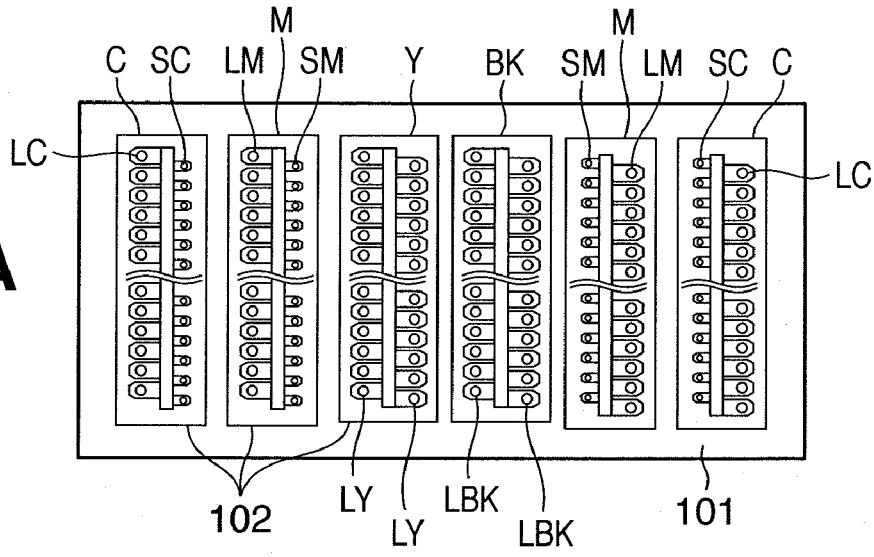
FIGS. 1A and 1B are schematic views showing an example of the arrangement of the nozzles (discharge apertures) of an inkjet printhead which can be used in an embodiment of the present invention.
Figure 1B:
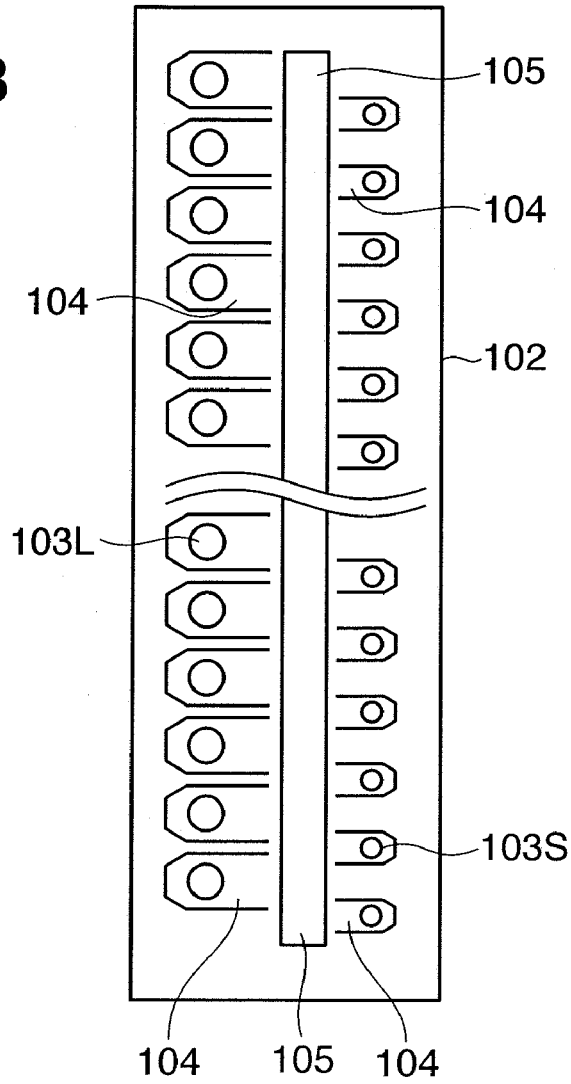

A printhead 101 is identical to the printhead 101 shown in FIGS. 1A and 1B, and comprises a combination of a nozzle array which discharges ink in a large discharge amount and a nozzle array which discharges ink in a small discharge amount. The internal arrangement of each nozzle which includes an ink flow path and the like is the same as that described above. In addition, the apparatus arrangement is the same as the arrangement shown in FIG. 2, and is configured to perform 1-pass printing operation of completing an image by performing one main printing/scanning operation with respect to the same printing area. This point is also the same as that described in the prior art.

Figure 8:
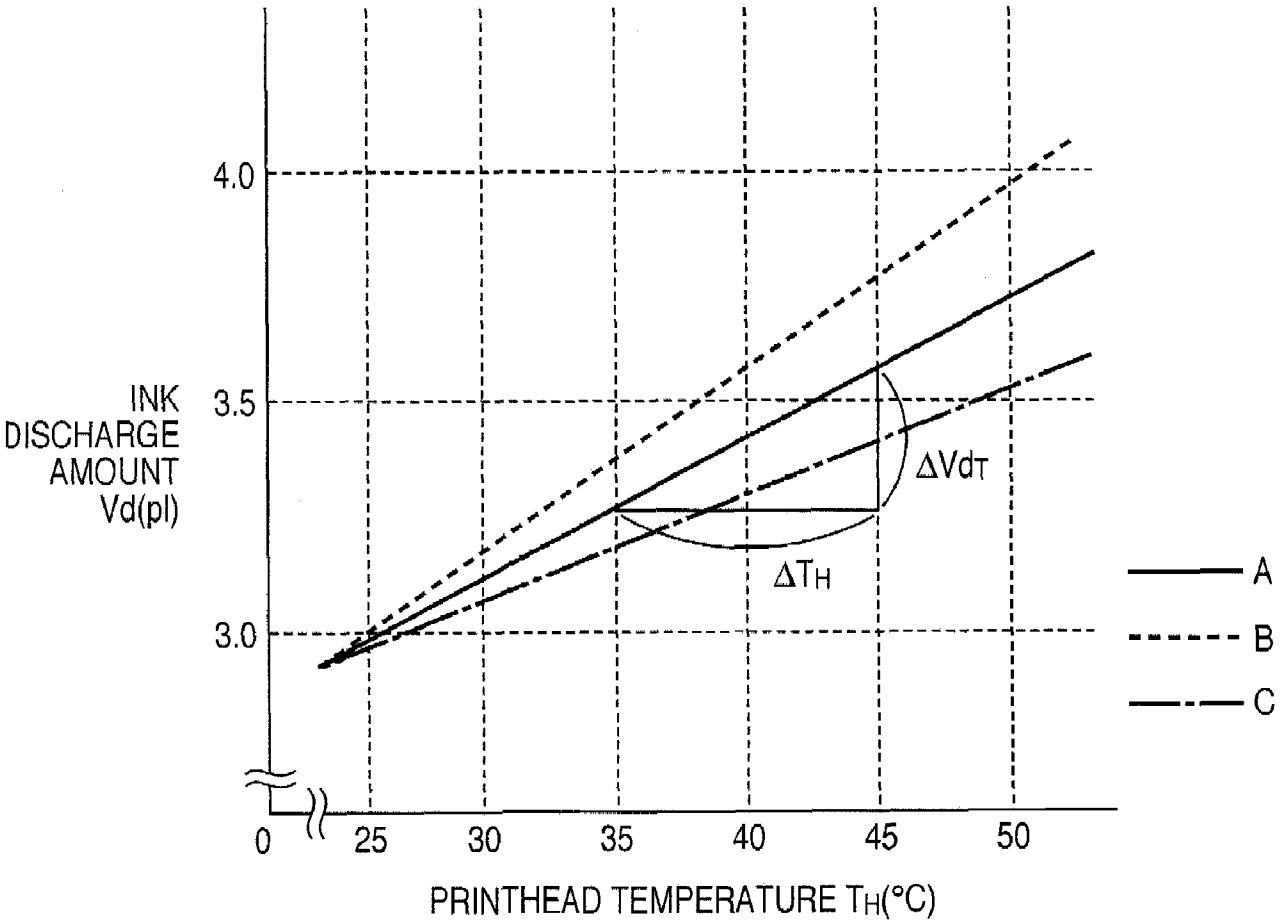
FIG. 8 is a graph showing the temperature dependence of ink discharge amount in a case wherein conditions for driving pulses are fixed.

The ink temperature of an ink discharge unit (the temperature of the ink printhead 101 in some case) is a factor which determines the ink discharge amount of the printhead 101. FIG. 8 is a graph showing the temperature dependence of ink discharge amount in a case wherein a driving pulse condition is fixed. As indicated by a solid line A in FIG. 8, an ink discharge amount Vd linearly increases with an increase in a printhead temperature $T_H$ (which is equal to the ink temperature of the discharge unit because this graph represents a static temperature characteristic). If the slope of this straight line is defined as a temperature dependence coefficient KT, the temperature dependence coefficient KT is given by $$KT=\Delta VdT/\Delta T_H(pl/^\circ C\cdot\text{dots})$$

The temperature dependence coefficient KT is determined by the physical properties of the printhead 101 and ink and the like regardless of driving conditions. Referring to FIG. 8, a broken line B and a chain line C indicate temperature dependences of other printheads.

This embodiment controls a variation in ink discharge amount due to a fluctuation in the above ink temperature by using image correcting operation of modifying the total number of dots of image data to be printed so as to make the printing density on printing paper P constant. In this case, a method of modifying multilevel data is used as a correction method for image data.

That is, a data converting unit 718 in an image signal processing unit 704 generates a binary pattern corresponding to a tone value "K" indicated by each pixel of input multilevel image data with respect to the image data input from the host apparatus and held in an image input unit 703. If, for example, the image input unit 703 receives multilevel image data represented by four bits (16 tones), the data converting unit 718 converts the input image data into binary data. The following will exemplify a case wherein a conversion process based on area coverage modulation is used as a binarization process for the input image data.

Figure 10A:
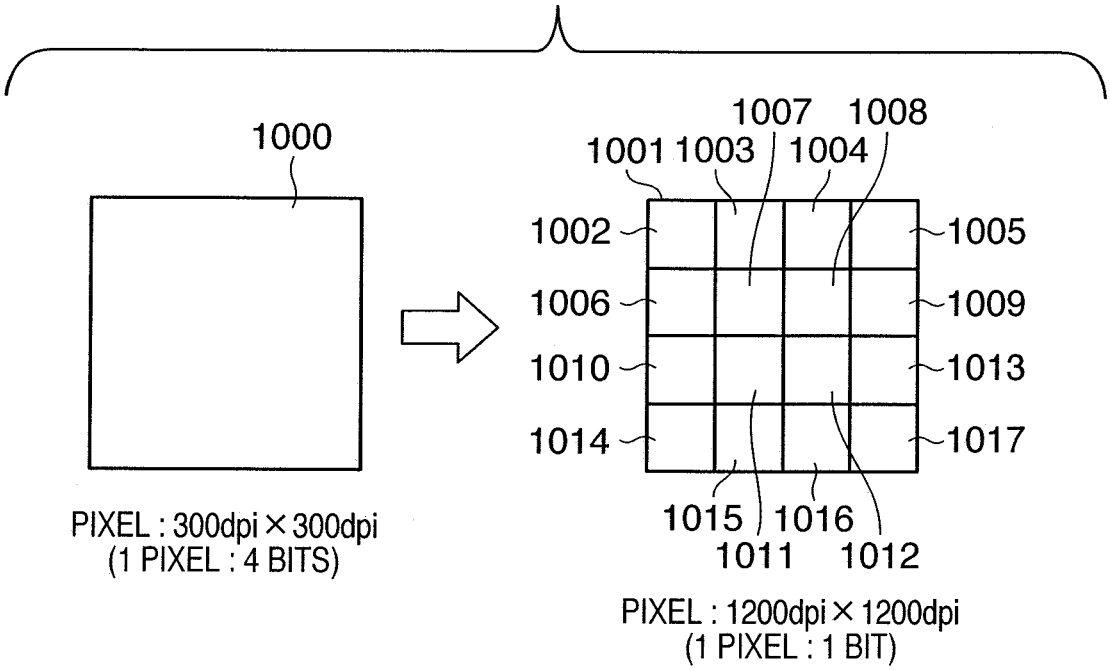
FIGS. 10A and 10B are views for explaining conversion of multilevel image data expressed by four bits (16 tones) into binary image data expressed by one bit (two tones) as an intermediate process.

The following will exemplify a case wherein an external host apparatus sends image data each pixel of which has a size of (1/300) inch square (a resolution of 300×300 dpi) as indicated by pixel data 1000 in FIG. 10A. This embodiment will exemplify a case wherein the printhead 101 shown in FIGS. 1A and 1B performs printing with a combination of ink LC with a large ink discharge amount, ink SC with a small ink discharge amount, ink LM with a large ink discharge amount, ink SM with a small ink discharge amount, ink LY with a large ink discharge amount, and ink LBK with a large ink discharge amount. In this case, assume that the host apparatus sends 4-bit (16-tone) image data for each color with each ink discharge amount.

Figure 9:
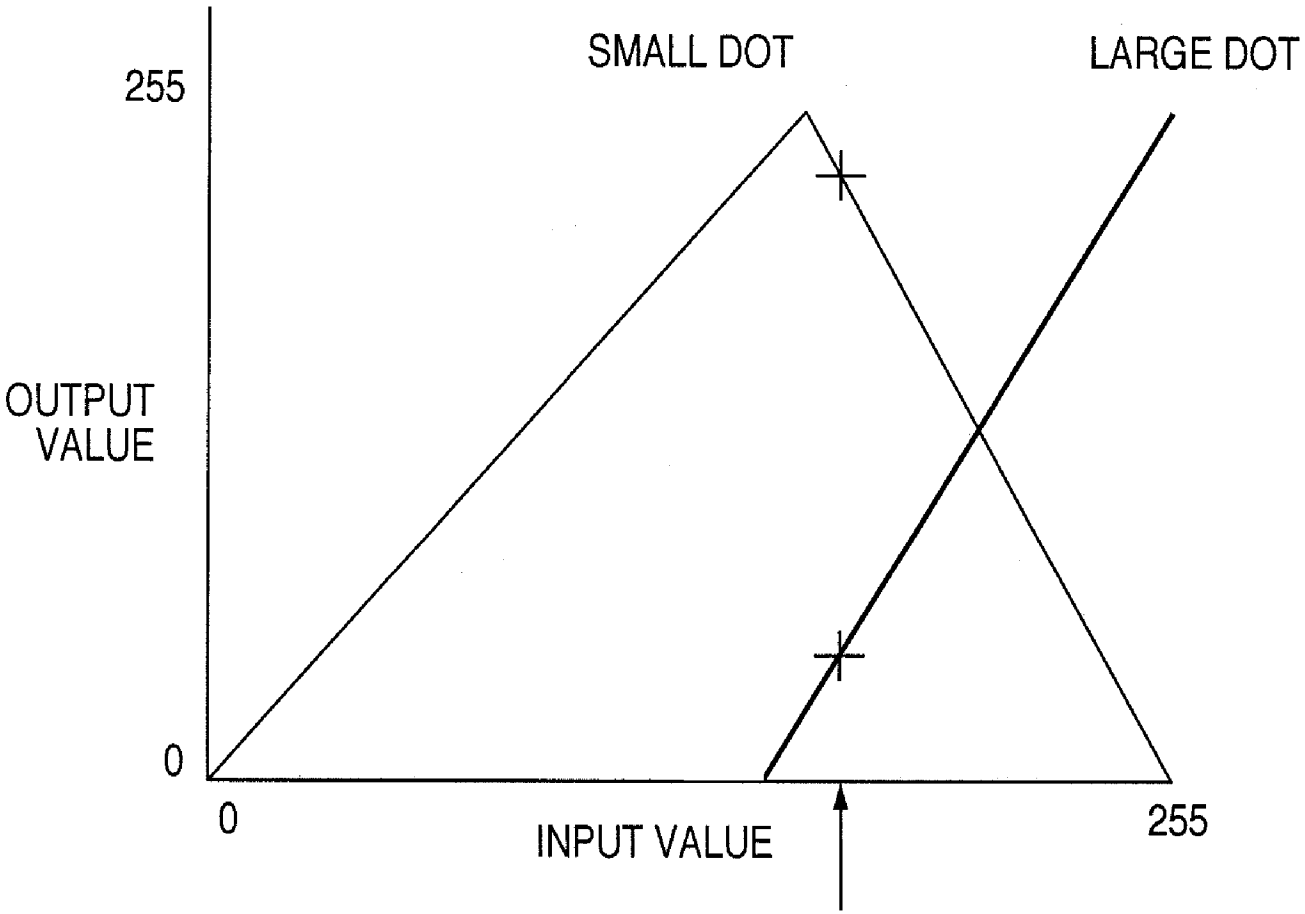
FIG. 9 is a graph for explaining image conversion which is used in an embodiment of the present invention when an input image is printed with large and small ink discharge amounts.

The following is a case wherein input image data is converted into printing data for each of the nozzle arrays with different ink discharge amounts since nozzle arrays with different ink discharge amounts are used for cyan C and magenta M. As shown in FIG. 9, this apparatus converts input image data into printing data based on small dots and printing data based on large dots by referring to a LUT (Look Up Table) in accordance with the input values of the image data. The apparatus binarizes each data by a binarization method to be described later. For example, at the tone indicated by the arrow in FIG. 9, the apparatus prints in a state wherein large and small dots are coexistent, and reproduces, on the printing paper P, a density corresponding to the tone of the input image data.

For this reason, this apparatus performs a pseudo-halftone process and resolution converting process for each input image data of each color with each ink discharge amount. More specifically, the apparatus assigns 4×4 pixels to one pixel of input image data vertically and horizontally, and replaces tone values ranging from 0 to 15 in each unit matrix of 4×4 pixels with 0 to 15 representing the numbers of discharged "1" dots in each unit matrix.

Figure 10B:
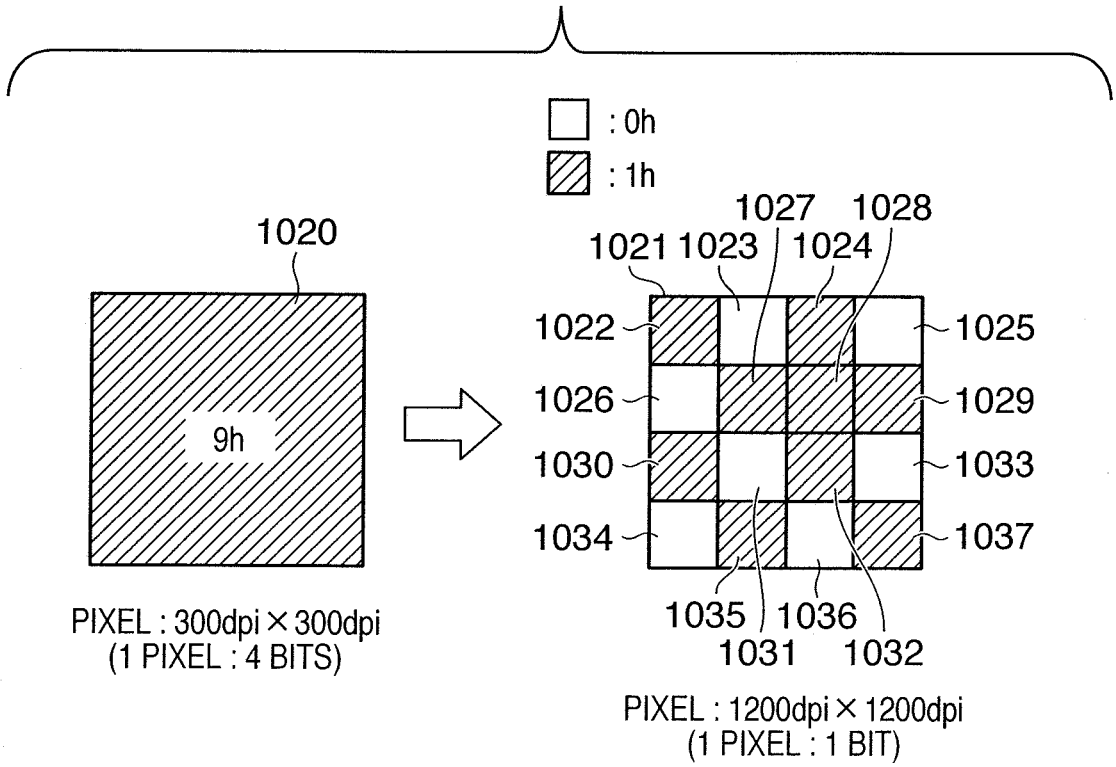
Figure 11:
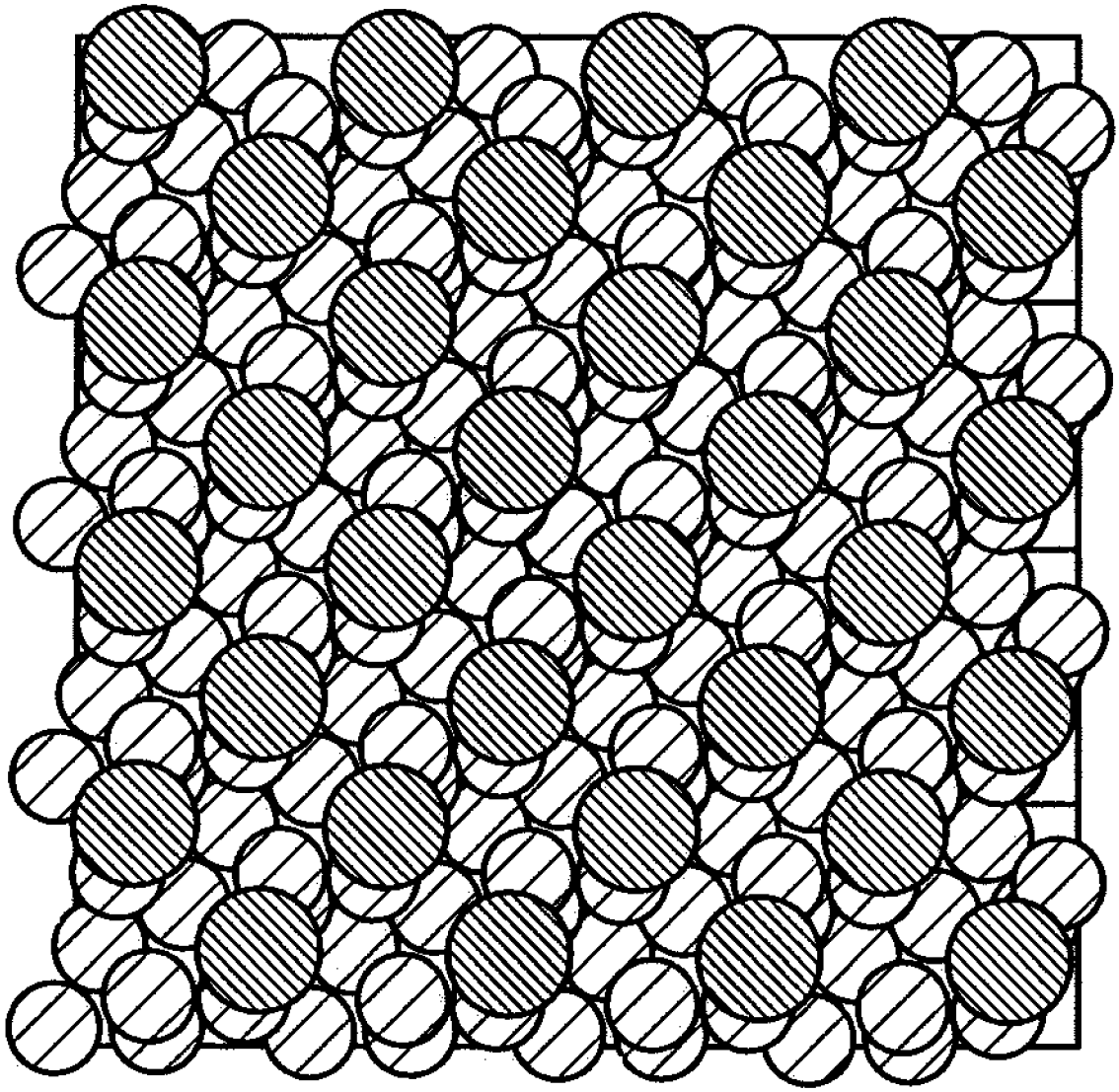
FIG. 11 is a view showing the state of printed dots.

Assume that one dot has a size of (1/1200) inch square (a resolution of 1200×1200 dpi) in both the main scanning direction and the sub-scanning direction. This apparatus then generates printing data 1001 (1002 to 1017) corresponding to the original 1-pixel data 1000, with each pixel being represented by one bit (two tones) for each color ink of LC, SC, LM, SM, LY, and LBK with each ink discharge amount, and prints on the basis of the printing data 1001. FIG. 10B shows the conversion of pixel data 1020 (a resolution of 300×300 dpi) of one pixel (four bits) whose pixel value is "9 h" (h represents a hexadecimal number), which is sent from the host apparatus. That is, FIG. 10B shows a case wherein the pixel data 1020 is converted into 9-dot printing data 1021 comprising printing data (a dot resolution of 1200×1200 dpi) each pixel of which is represented by one bit.

As pseudo-halftone process and resolution converting process techniques, various techniques have been proposed. In this case, the apparatus converts printing data (a resolution of 300×300 dpi) each pixel of which comprises four bits and which is sent from the host apparatus into 16 tones by using printing data (a resolution of 1200×1200 dpi) each dot of which is represented by one bit and which is prepared in advance, in accordance with the value of each pixel. The apparatus then simultaneously performs a pseudo-halftone process and resolution converting process by the technique of referring to a LUT (Look Up Table).

In this case, when using the LUT for separating input image data into large and small dots, the apparatus uses a resolution converting process based on area coverage modulation as a binarization process for input image data. However, the present invention is not limited to this. The present invention may generate printing data for large and small dots, and can perform a pseudo-halftone process by using an arbitrary processing method such as an average density storage method or a dither matrix method.

This embodiment counts large and small dots corresponding to one color, which are formed by the 128 nozzles of a nozzle array for large dots and the 128 nozzles of a nozzle array for small dots which are used for cyan and magenta, in a predetermined number of divided areas, thereby correcting the image data.

Figure 12:
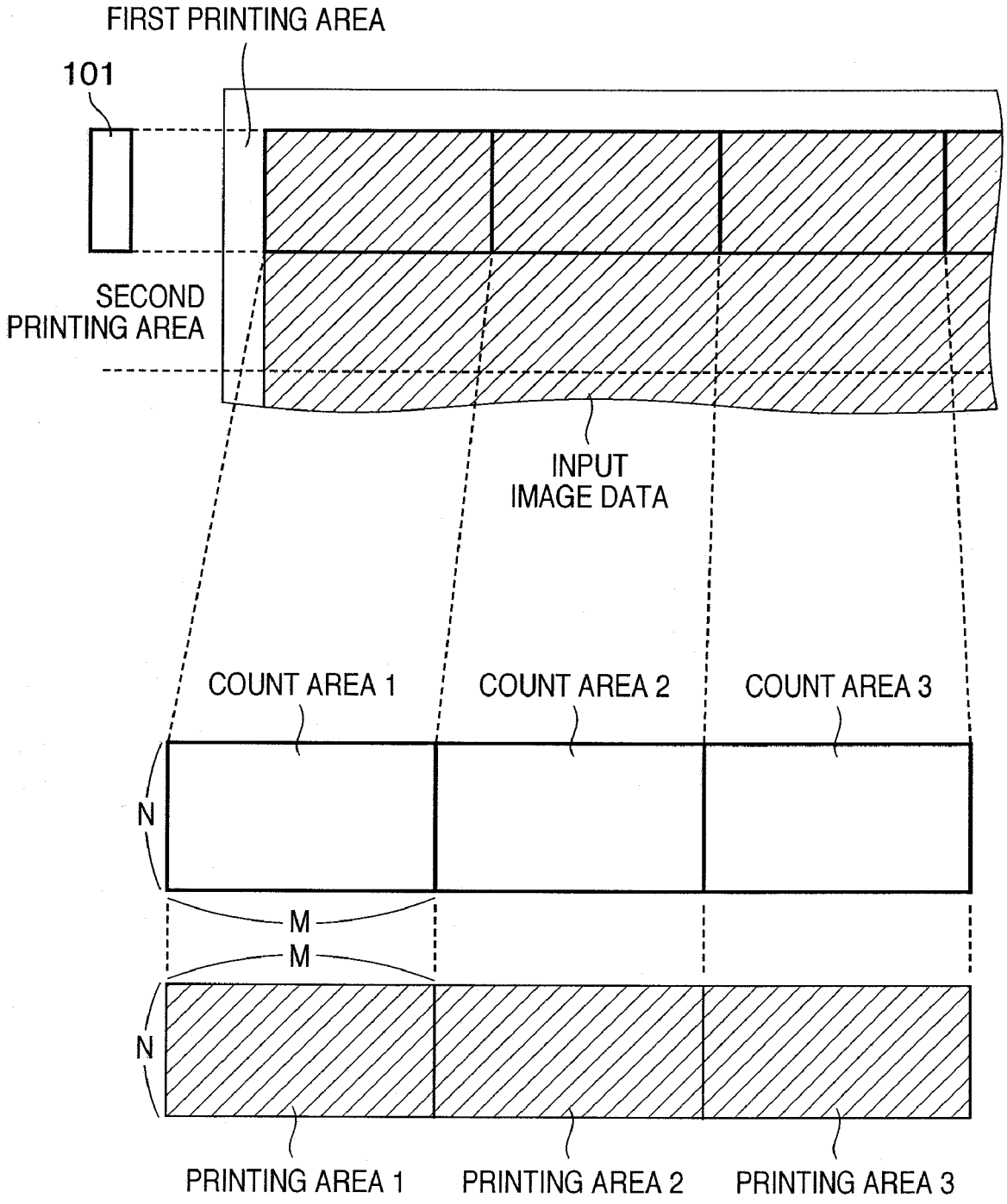
FIG. 12 is a view for schematically explaining the concept of count areas for counting the numbers of dots printed and printing areas in which the numbers of dots of printing data are modified, which are used in an embodiment of the present invention.

FIG. 12 is a view for schematically explaining the concept of count areas for counting the numbers of dots to be printed and printing areas in which the numbers of dots of printing data are modified. Referring to FIG. 12, for the sake of easy understanding, the size of each count area is set to be the same as that of each printing area. This setting applies to the following description of all the embodiments of the present invention. As will be described later, however, it is not essential for the present invention to set the size of each count area to be the same as that of each printing area. That is, it suffices to set the size of each count area to be different from that of each printing area.

Figure 13:
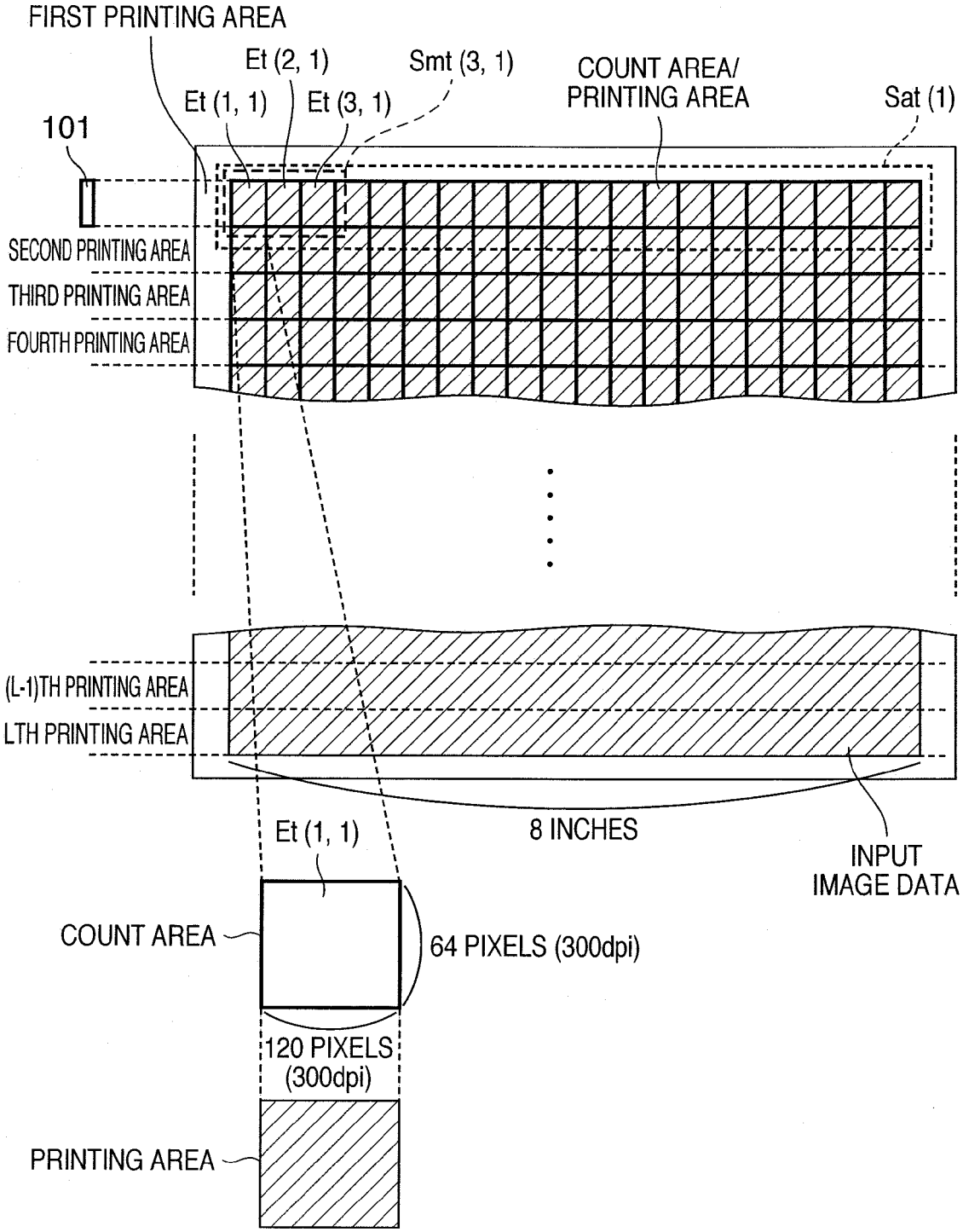
FIG. 13 is a view for schematically explaining the divided state of count areas for counting the numbers of dots printed and printing areas in which the numbers of dots of printing data are modified.

This embodiment will exemplify a case wherein an entire printing area is printed by 1=L scans. FIG. 13 shows printing data corresponding to one main scan of the printhead 101 in the first scanning operation, that is, input image data equivalent to image data corresponding to (number of nozzles) x (number of pixels printed on one line in scanning direction). That is, the input image data is divided into N portions in the vertical direction (nozzle array direction)×M portions in the horizontal direction (scanning direction), that is, N (in the vertical direction)×M (in the horizontal direction) count areas and printing areas, each including the same number of pixels having multilevel information.

More specifically, assume that when the printhead 101 having a total of 256 large and small nozzles is to be used, the resolution is set to 300×300 dpi. In this case, the input image data is divided upon setting 64 pixels (=256/4) in the vertical direction (nozzle array direction) to N=1 and a printing width of eight inches in the horizontal direction (scanning direction) to M=20. The printing width is 2,400 pixels (=8×300). Therefore, the size of each of the count and printing areas is set to 64 (vertical)×120 (horizontal). Assume that the data of tone values 0 to 15 correspond to the respective pixels in the count and printing areas.

Assume that the number of droplets discharged in the count area corresponding to the mth row and the nth column which is obtained by accumulating multilevel data tone values in the area as a count result in each count area is represented by a dot count value Et (m, n). Assume also that the accumulated number of droplets discharged (in the horizontal direction) of the numbers of droplets discharged in the respective nth count areas in the vertical direction is represented by a count value Smt(m, n). Similarly, assume that the total number of the accumulated numbers of droplets discharged in printing operation from the start of printing to an immediately preceding scan is represented by a total dot count value Sat(1−l), and a correction amount calculated for each printing area is represented by Ht(m, n).

More specifically, referring to FIG. 13, the value represented by Smt(3, 1) is the sum of Et(1, 1) to Et(3, 1) which are the number of droplets discharged in the first count area in the vertical direction to the third count area in the horizontal direction. In addition, Sat(1) represents the same value as Smt(20, 1) which is the accumulated number of droplets discharged in all the count areas in the horizontal direction in each scan. Furthermore, Ht(1, 1) represents a printing data correction amount (the number of dots) in the printing area corresponding to the first row and the first column.

Figure 14:
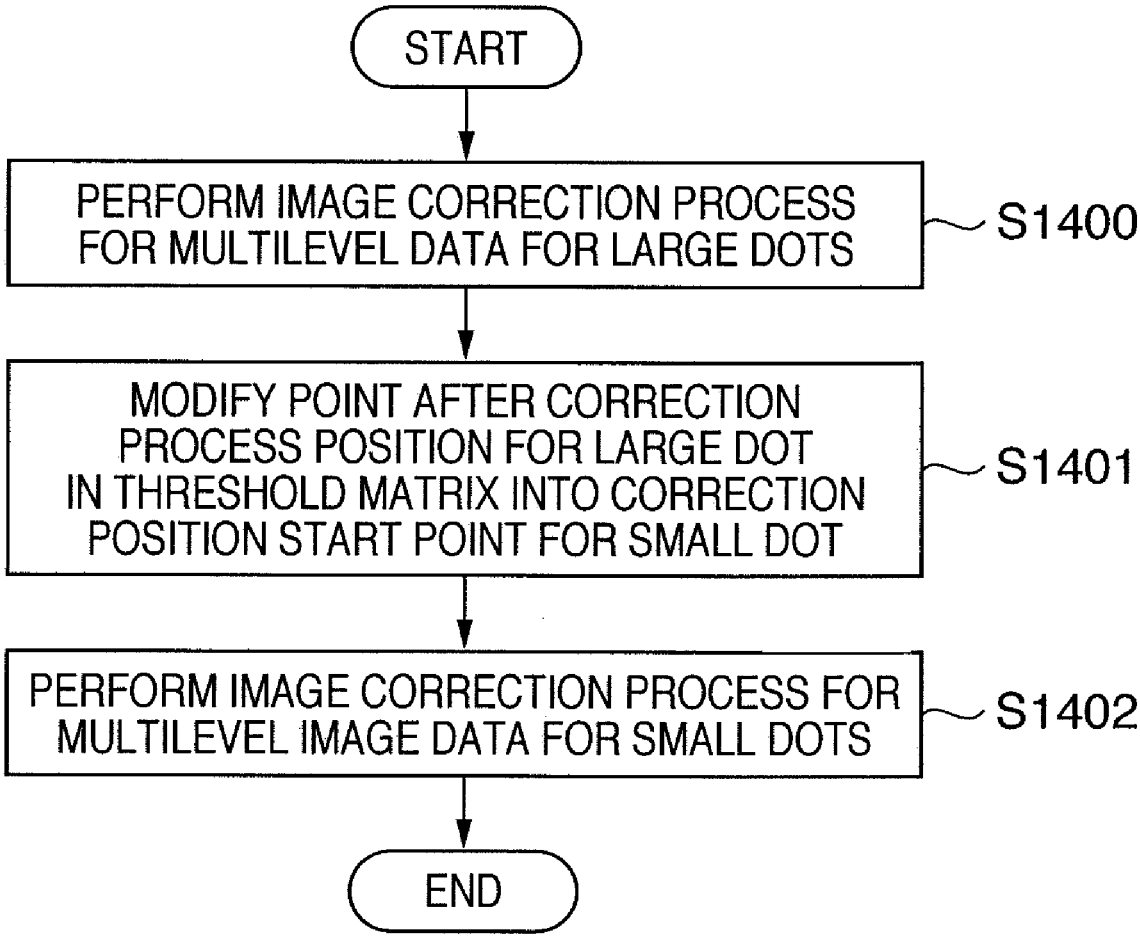
FIG. 14 is a flowchart showing processing for each ink discharge amount which is performed for each scan in an embodiment of the present invention.
Figure 15:
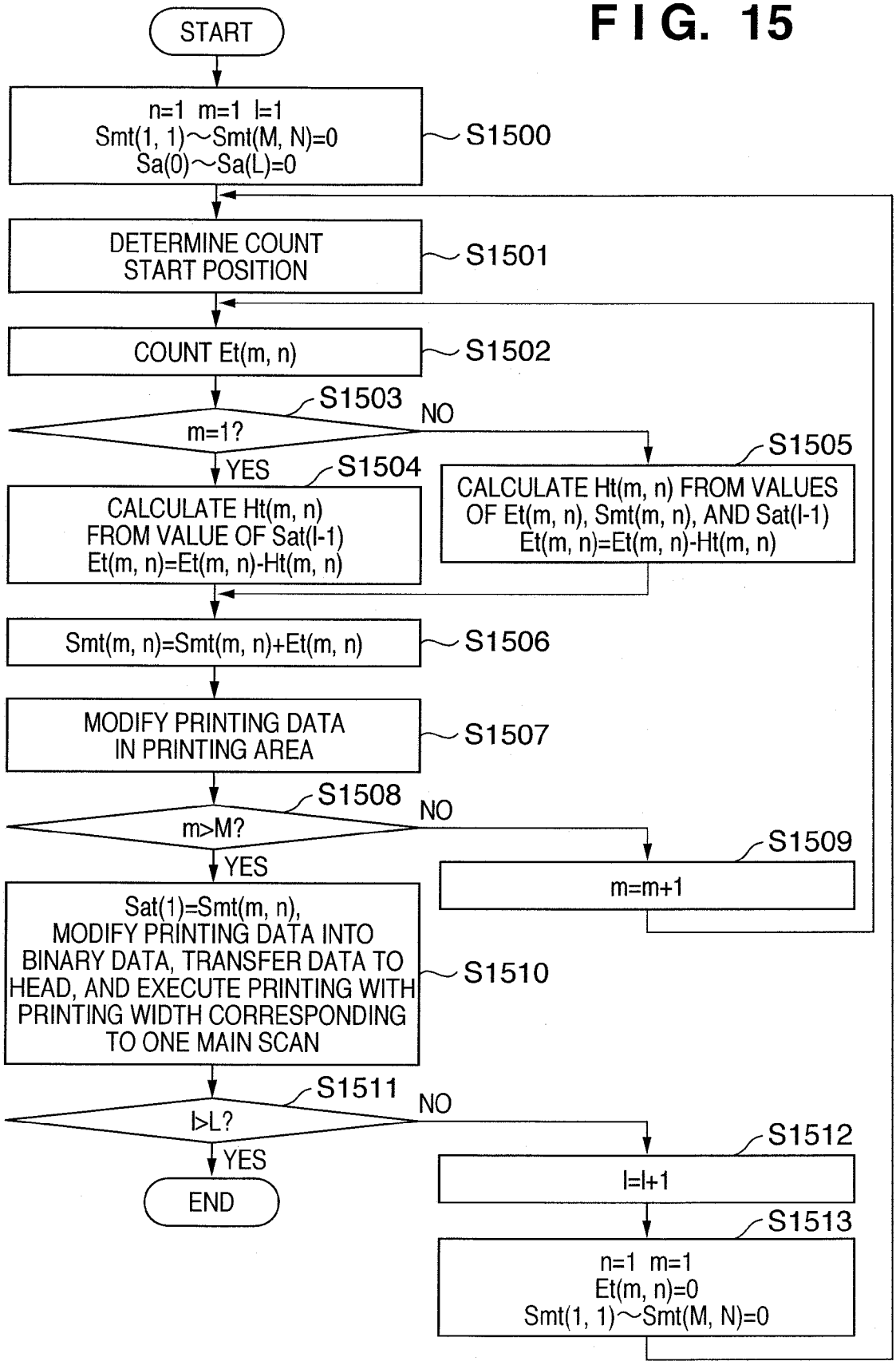
FIG. 15 is a flowchart showing the processing of counting the number of dots of printing data and the processing of correcting printing data on the basis of a count result.

FIG. 14 is a flowchart showing processing in the first embodiment. FIG. 15 is a flowchart showing the processing of counting the number of dots of pixel data of each image data corresponding to each discharge amount in each scan in the first embodiment, the processing of correcting the pixel data on the basis of the count result, and the like.

As shown in FIG. 14, in each printing/scanning operation, first of all, in step S1400, this apparatus converts the pixel values of multilevel image data corresponding to large dots by determining modified pixel positions at which image correction is sequentially performed for the data by using a threshold matrix (to be described later). In step S1401, when starting correcting multi-tone image data corresponding to small dots, the apparatus modifies the correction start position of the small dots so as to designate pixel positions at which correction is performed for the small dots after the value of the threshold matrix by which conversion has already been executed by using large dots. Thereafter, in step S1402, the apparatus executes an image correction process for the multi-tone image data for small dots.

FIG. 15 is a flowchart showing, in detail, operation in a correction process for each multi-tone image data. This flowchart will be described in detail below. This apparatus starts this process for each scan. First of all, in step S1500, the apparatus sets a count area Et(m, n) of interest with m=1, n=1, and l=1, and initializes a memory area such as a register which stores the values of Smt(1, 1) to Smt(M, N) and Sat(0) to Sa(L).

In step S1501, the apparatus matches the data start position of input image data which corresponds to the first printing data with the count start position of a count area. In step S1502, the apparatus counts the sum of tone values in the count area of the interest specified by all the values of m=1 and n=1 of the first count area in the horizontal direction, and temporarily stores the dot count value of the count area as Et(1, 1) in the memory area.

In step S1503, the apparatus determines whether the count area of interest is the first area in the horizontal direction, that is, is located at the start position in the scanning direction. If the result is YES in step S1503, the process advances to step S1504, otherwise, the process advances to step S1505.

In step S1504, the apparatus performs processing on the basis of the count data of a total dot count value Sat(0) (0 at this point because the first printing/scanning operation is performed, that is, l=1, and hence no discharge is performed immediately before this operation) representing the total number of dots discharged from the start of printing to printing in the immediately preceding scanning operation. That is, the apparatus computes a predicted value of increasing density based on an increase in ink discharge amount, and calculates a correction amount Ht(1, 1) of the printing data of the area specified by the values of m=1 and n=1 of the first printing area in the horizontal direction. The apparatus then computes a count value, as a new value Et(1, 1), from Et(1, 1) which is the same value as the count value in this printing area and the calculated correction amount Ht(1, 1).

In step S1506, the apparatus adds Et(1, 1) obtained by the above operation to an accumulated dot count value Smt(m, n) in the horizontal direction, and stores the resultant value as the value of a new count value Smt(1, 1) in a corresponding memory area.

In step S1507, the apparatus executes correction equivalent to the above correction amount Ht(1, 1) with respect to the printing data in the first printing area in the horizontal direction, and modifies the number of printing data in the printing area. The apparatus modifies the printing data by modifying the tone values of the pixels in the printing area by a numerical value equivalent to the correction amount on the basis of the sequence of the threshold matrix.

In step S1508, the apparatus determines whether m>M (=20). If m<M, the process advances to step S1509 to increment the value of m by one to shift the count area by one pixel in the printing/scanning direction. The process then returns to step S1502.

The apparatus then repeats the processing from step S1502 to step S1509 with m=2 to execute correction for the printing data in the printing area. First of all, in step S1502, the apparatus sets the dot count value of the second count area of interest in the horizontal direction to Et(2, 1), and temporarily stores it in the memory area. In step S1503, since the count area of interest is the second area in the horizontal direction, the process advances to step S1505.

The apparatus performs the processing in step S1505 in the following manner. That is, the apparatus performs the processing on the basis of three kinds of count data, i.e., the two kinds of count values Et(1, 1), and Smt(1, 1) and the total dot count value Sat(0) (0 because l=1, which indicates there is no discharge immediately before this operation) representing the total number of dots discharged from the start of printing to printing in the immediately preceding scanning operation. That is, the apparatus computes a predicted value of increasing density based on an increase in ink discharge amount, and calculates a correction amount Ht(2, 1) of the printing data of the area specified by the values of m=2 and n=1 of the second printing area in the horizontal direction. The apparatus then computes a count value, as a new value Et(2, 1), from Et(2, 1) which is the same value as the count value in this printing area and the calculated correction amount Ht(2, 1).

In step S1501, the apparatus adds Et(2, 1) obtained by the above operation to an accumulated dot count value Smt(1, 1) in the horizontal direction, and stores the resultant value as the value of a new accumulated dot count value Smt(2, 1) in the horizontal direction in a corresponding memory area.

In step S1507, the apparatus executes correction equivalent to the above correction amount Ht(2, 1) with respect to the printing data in the second printing area in the horizontal direction, and modifies the number of printing data in the printing area. In step S1508, the apparatus determines whether m>M (=20). If m<M, the process advances to step S1509 to increment the value of m by one to shift the count area by one pixel in the printing/scanning direction. The process then returns to step S1502.

Subsequently, the apparatus repeats the processing from steps S1502 to S1509 with respect to all values of m (1 to M) to complete correction for the printing data in the corresponding printing area.

In step S1510, the apparatus sets the value of the accumulated dot count value Smt(m, n) in the horizontal direction (which matches Smt(20, 1)at this point) as a new total dot count value Sat(l) (l=1 at this point), and stores it in the memory area. The data converting unit 718 in the image signal processing unit 704 in FIG. 7 further processes the corrected data. That is, the data converting unit 718 executes a resolution converting process of converting 1-pixel (4-bit) pixel data (a resolution of 300×300 dpi) into data (at a resolution of 1200×1200 dpi) each pixel of which is presented by one bit. The apparatus further transfers the converted printing data to the printhead 101 to execute printing with a printing width corresponding to one main scan. The apparatus starts a correction process for printing data corresponding to a main scan in the next printing operation concurrently with this printing operation.

In step S1511, the apparatus determines whether l>L. If 1>L, the apparatus finishes the process. If l<L, the process advances to step S1512 to increment the value of 1 by one to shift the count area by one in the vertical direction. In step S1513, the apparatus initializes the memory to 0, which temporarily stores the count value Et(m, n) in the count area of interest and the accumulated dot count value Smt(m, n) of the values counted in the previous scan. Subsequently, the apparatus repeats the processing from step S1501 to step S1513 to complete an image by discharging ink from the printhead 101 on the basis of the corrected printing data while sequentially performing counting and a correction process for the printing data. Note that this embodiment uses a method of changing the tone value level of multilevel data as a method of correcting image data.

FIG. 16 schematically shows input multilevel image data in an arbitrary area of printing data. At this time, the total number of dots of the printing data matches the accumulated tone value of the input image data.

Figure 17:
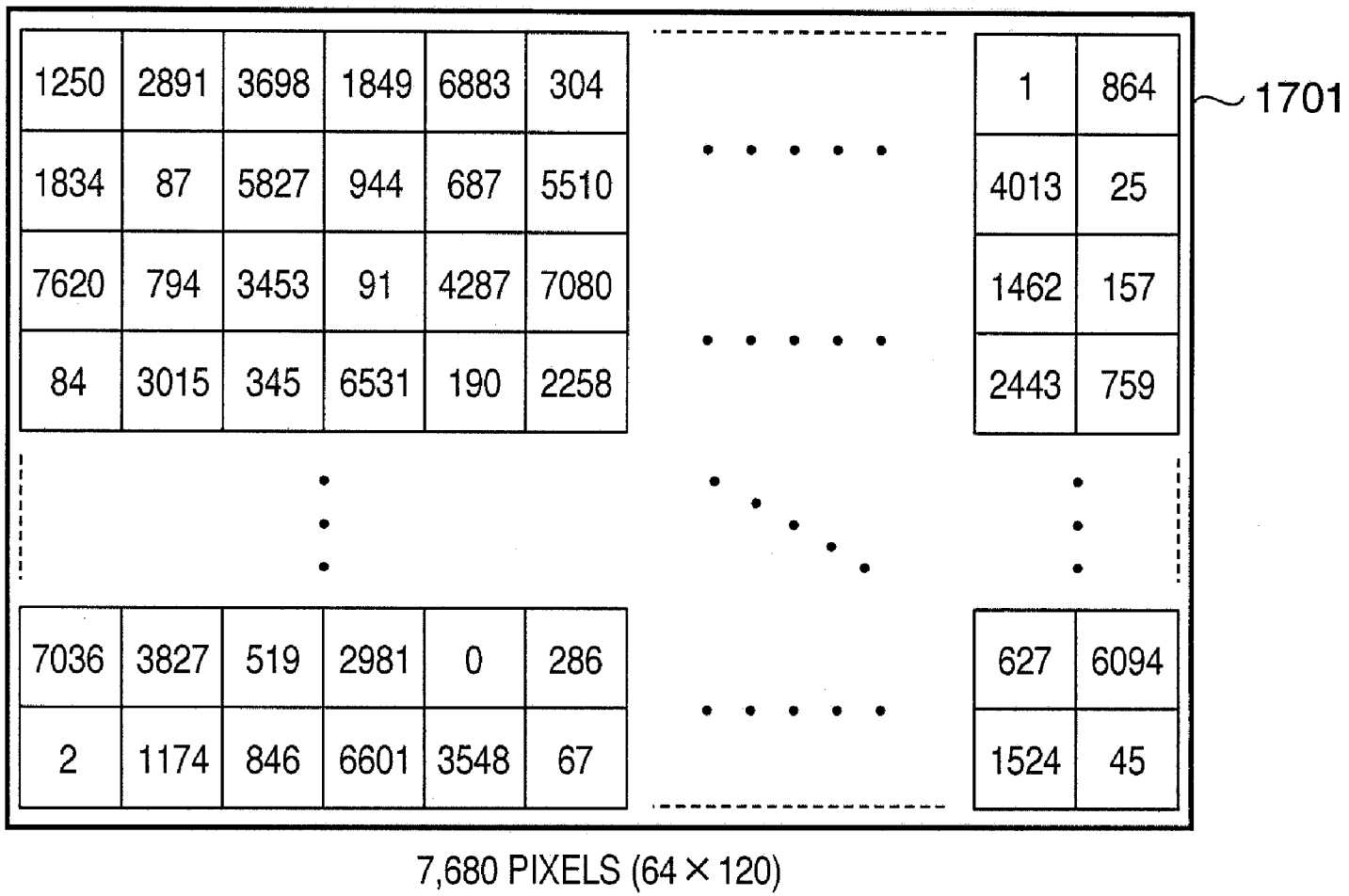
FIG. 17 is a view showing a threshold matrix used for the correction of printing data in an embodiment of the present invention.

First of all, with regard to multilevel image data for large dots, in steps S1504 and S1505 in the flowchart of FIG. 15, the apparatus calculates, as a correction amount, a value which is subtracted from the accumulated data tone value of the input image data. At this time, the apparatus decreases an arbitrary pixel tone value of the input image data by one level and repeats this until the tone value becomes equal to the correction amount. At this time, the apparatus uses a method of preparing a threshold matrix mask with the same size as that of a count area and selecting a pixel as a method of selecting a pixel as a target whose tone value is-to be decreased. This threshold matrix is a matrix mask 1701 in which 0 to 7,679 (=64×120) are assigned to the respective pixels within the mask size (64×120 pixels) and which is shown in FIG. 17. The numerical values corresponding to the pixels at this time are sequenced such that the variance of the positions of all numerical values at arbitrary numbers becomes high.

The apparatus then performs the processing of decreasing the tone value of each corresponding pixel on the input image data by one level in accordance with the numerical order of the threshold matrix 1701. The apparatus sequentially subtracts the tone values of the pixels of the input image data in accordance with the sequence of the threshold matrix until the total number of pixels whose tone values are subtracted reach the calculated correction value. FIG. 18 is a schematic view for explaining the processing at this time in detail.

Consider a case wherein there is input image data 1801 in a given count area, and an accumulated dot count value of 3,000 and a value of 300 to be subtracted as a correction amount are calculated. In this case, the apparatus decreases the tone values of the input image, of all 7,680 pixels, which correspond to pixel positions 0 to 299 in a threshold matrix 1802 by one. The modified image data becomes like data 1803. In data 1803, the numerical values in the parentheses represent data-modified pixels.

Assume that as shown in FIG. 25, the number of pixels of input image data 2501 for large dots is 7,680 (=64×120) (300 dpi), the accumulated value of the tone values is 40,000, and a value to be subtracted as a correction amount is calculated as 9,000. In this case, since the subtraction value is larger than 7,680, the tone values of all the 7,680 pixels are decreased by one level. In addition, this apparatus further corrects the remaining 1,320 (=9000−7680) pixels by decreasing, by one, the tone values of the input image data which correspond to pixel positions 0 to 1319 in the threshold matrix. Reference numeral 2503 denotes data after the modification at this time. The tone values in the parentheses are obtained by decreasing their original values by two levels.

After determining pixel positions at which multilevel image data for large dots are to be corrected, the apparatus sequentially determines pixel positions at which correction for small dots is to be performed. Consider a case wherein the number of pixels of input image data 2501 for small dots is 7,680 (=64×120) (300 dpi), the accumulated value of the tone values is 30,000, and a value to be subtracted as a correction amount is calculated as 2,000. In this case, the apparatus decreases, by one, the tone values of the input image data which correspond to pixel positions 1320 to 3319 in the threshold matrix. This makes it possible to distribute the positions at which the tone values for large dots are decreased by two levels and the positions at which the tone values for small dots are decreased by one level with a high variance without making them overlap each other. Since the tone values for the large dots have already been decreased by one level as a whole, the correction for the large dots does not interfere with that for the small dots.

As described above, the apparatus executes correction for large dots at the positions corresponding to pixel positions 0 to 299, and then starts correction for small dots from pixel position 300. That is, upon calculating a correction amount for the corresponding count area for small dots as 700, the apparatus decreases, by one, the tone values of the input image data which correspond to pixel positions 300 to 999 in the threshold matrix. Since the number arrangement of the threshold matrix is designed with a high variance, the apparatus can determine correction positions for small dots with a high variance while exclusively avoiding correction positions for large dots. This embodiment need only use one kind of threshold matrix instead of preparing different threshold matrices for large and small dots. This also makes it possible to save memory space.

Figure 4A:
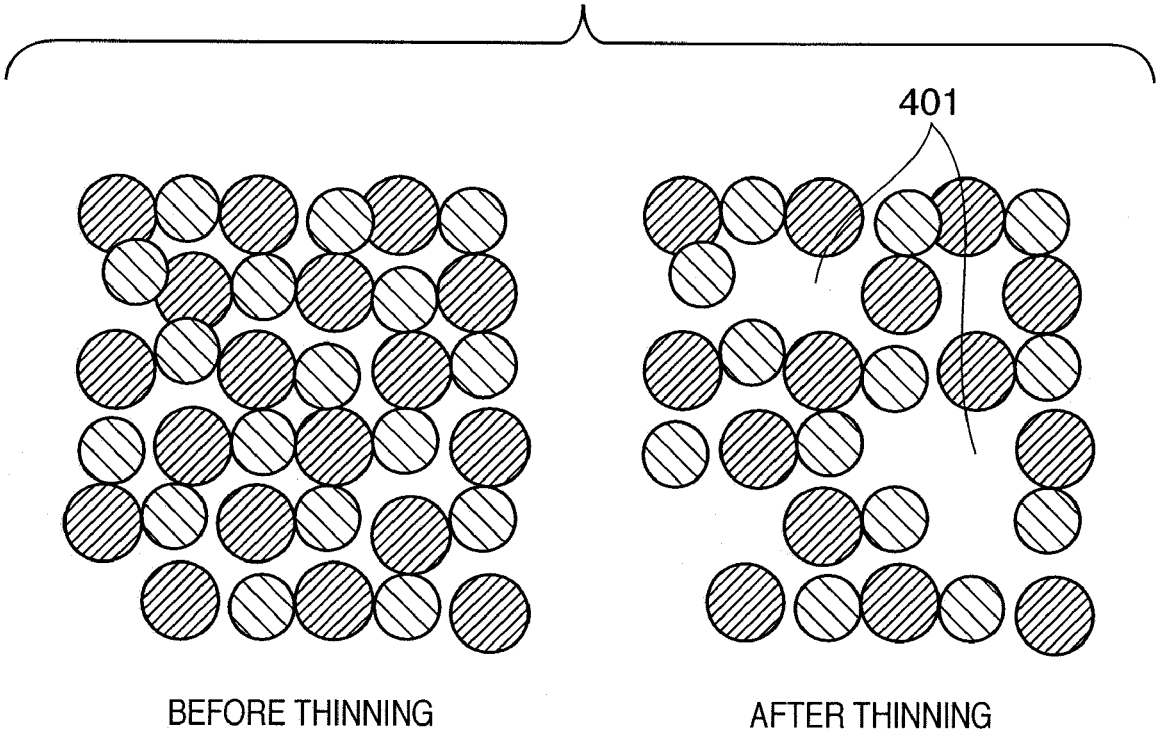
FIGS. 4A and 4B are schematic views showing a printed state which causes deterioration in graininess and an improved printed state in the present invention.
Figure 4B:
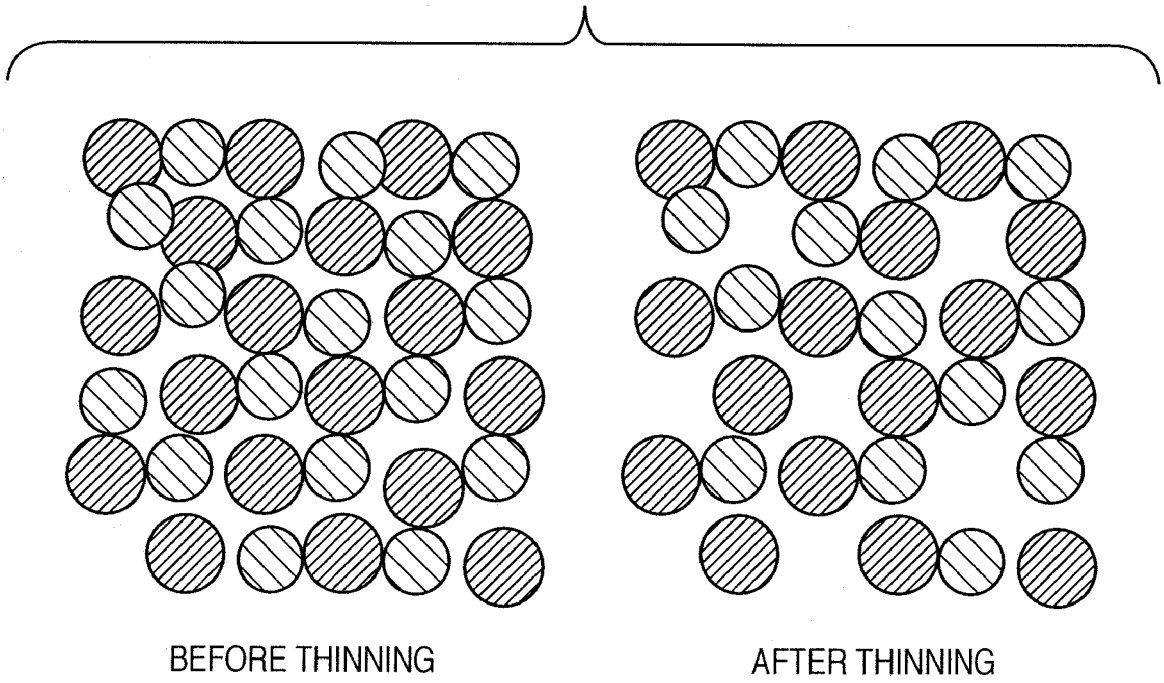
Figure 5:
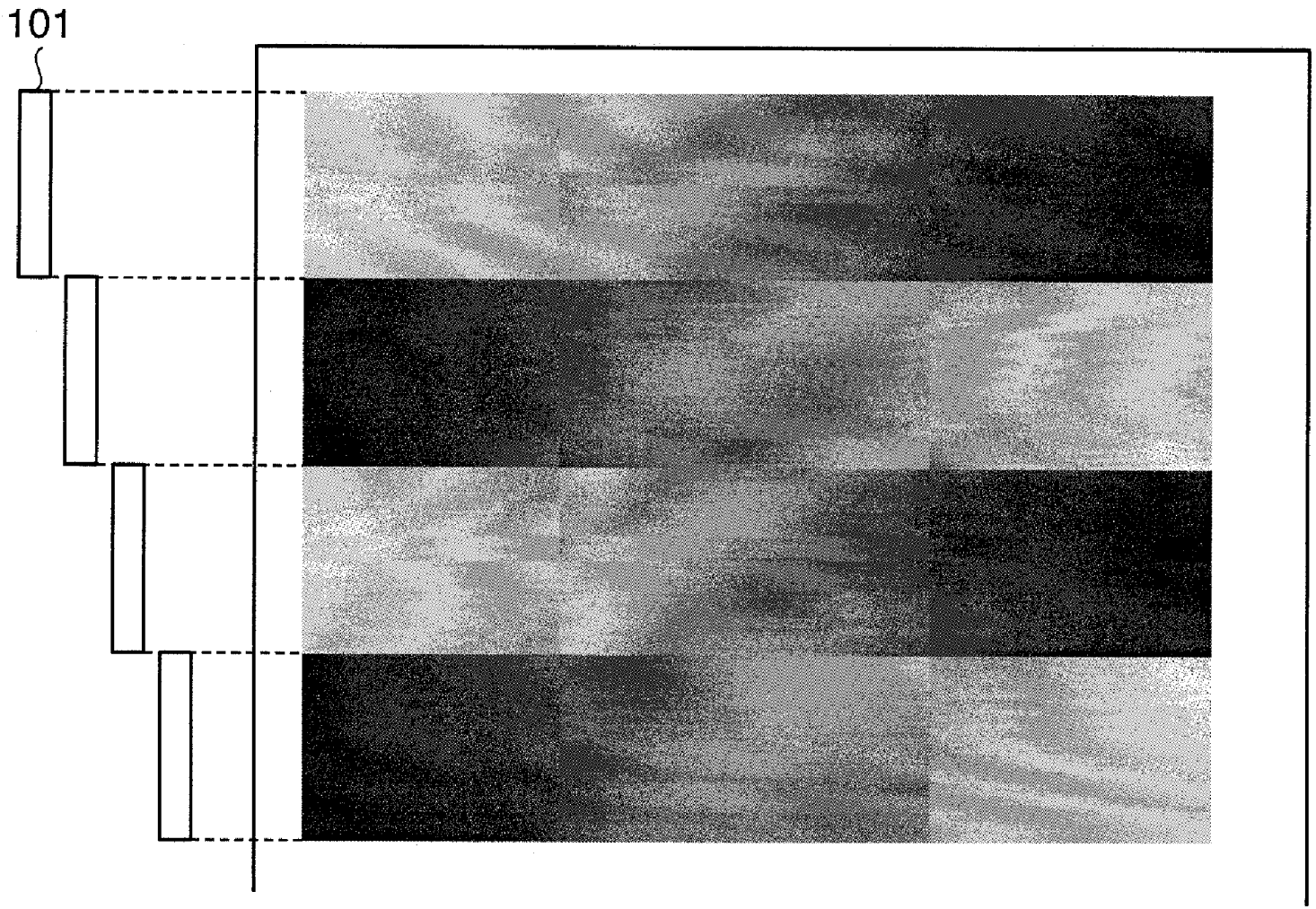
FIG. 5 is a view schematically showing a printed state when printing is performed by high-speed ink discharging operation in a conventional 1-pass printing mode.
Figure 6A:
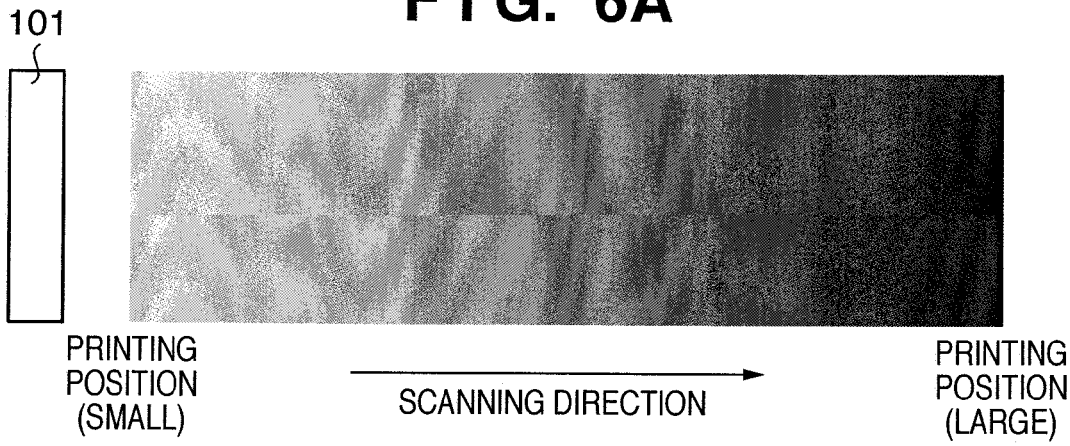
FIGS. 6A to 6D are views showing the state of a printing area in a case wherein a solid image with the same tone and different printing densities is printed by an arbitrary scan in the 1-pass printing mode, and graphs showing the relationship between changes in the printing position of the printhead, head temperature, and ink discharge amount in an inkjet printing apparatus.
Figure 6B:
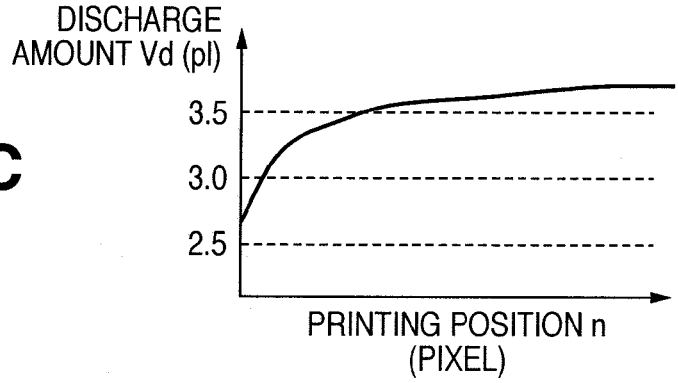
Figure 6C:
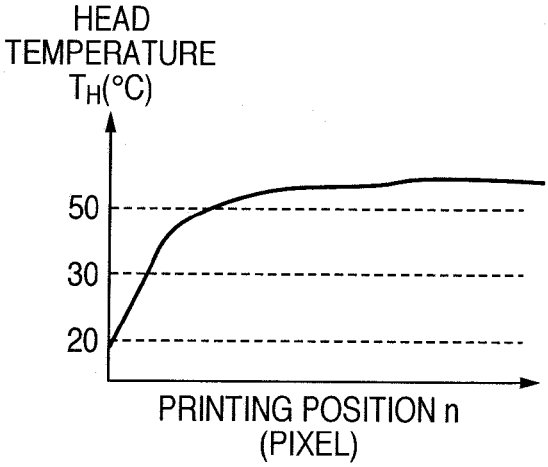
Figure 6D:
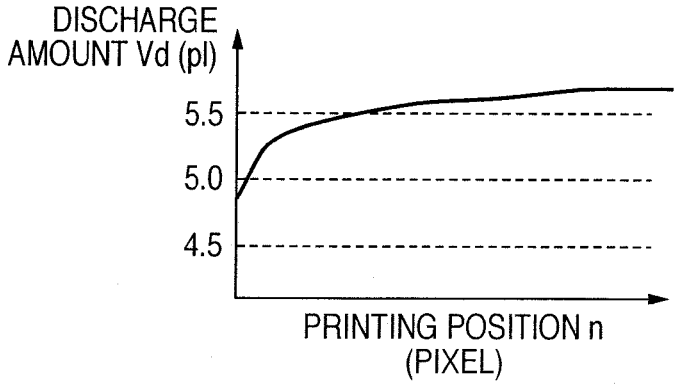

As described above, this embodiment divides printing data for large dots in the printing/scanning direction into a plurality of areas, counts the number of discharged data for each area, and modifies the number of dots to be discharged in a printing area in accordance with the duty cycle of the counted discharge data. Only modifying correction start positions in a threshold matrix makes it possible to determine correction positions for small dots exclusively from pixel positions at which correction is performed for large dots. Printing with the printing data corrected in this manner will perform correction for large dots with a high variance when reducing density irregularity due to an increase in ink discharge amount in the main scanning direction. As shown in FIG. 4B, the apparatus can also perform correction for small dots with a high variance without any deterioration in graininess due to interference between the correction positions for large dots with those for small dots.

Figure 19:
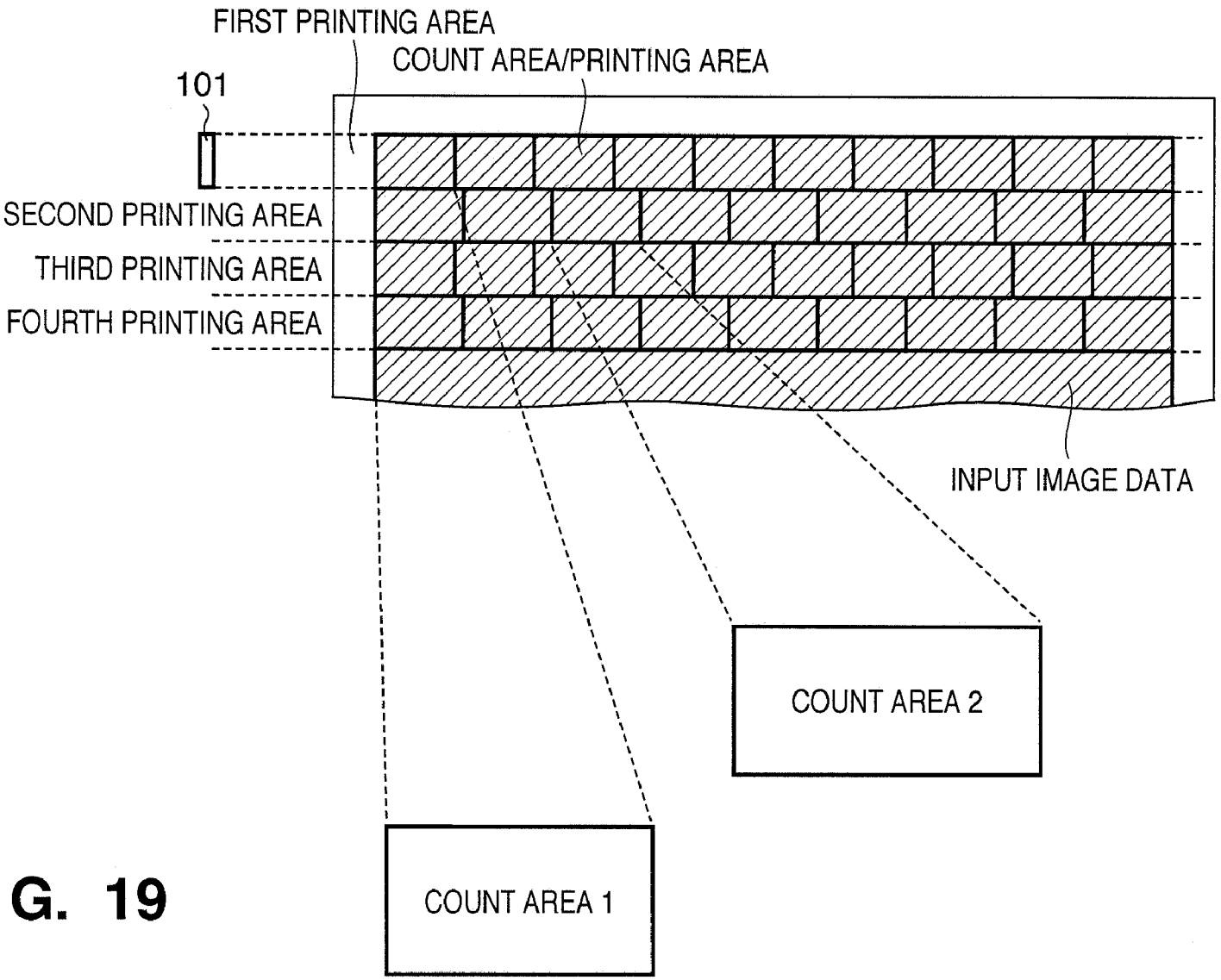
FIG. 19 is a view schematically explaining the divided state of count areas and printing areas in which the numbers of dots of printing data are modified in a case wherein a method of setting different division numbers and sizes for the respective scans is used as a count area dividing method in an embodiment of the present invention.
Figure 20:
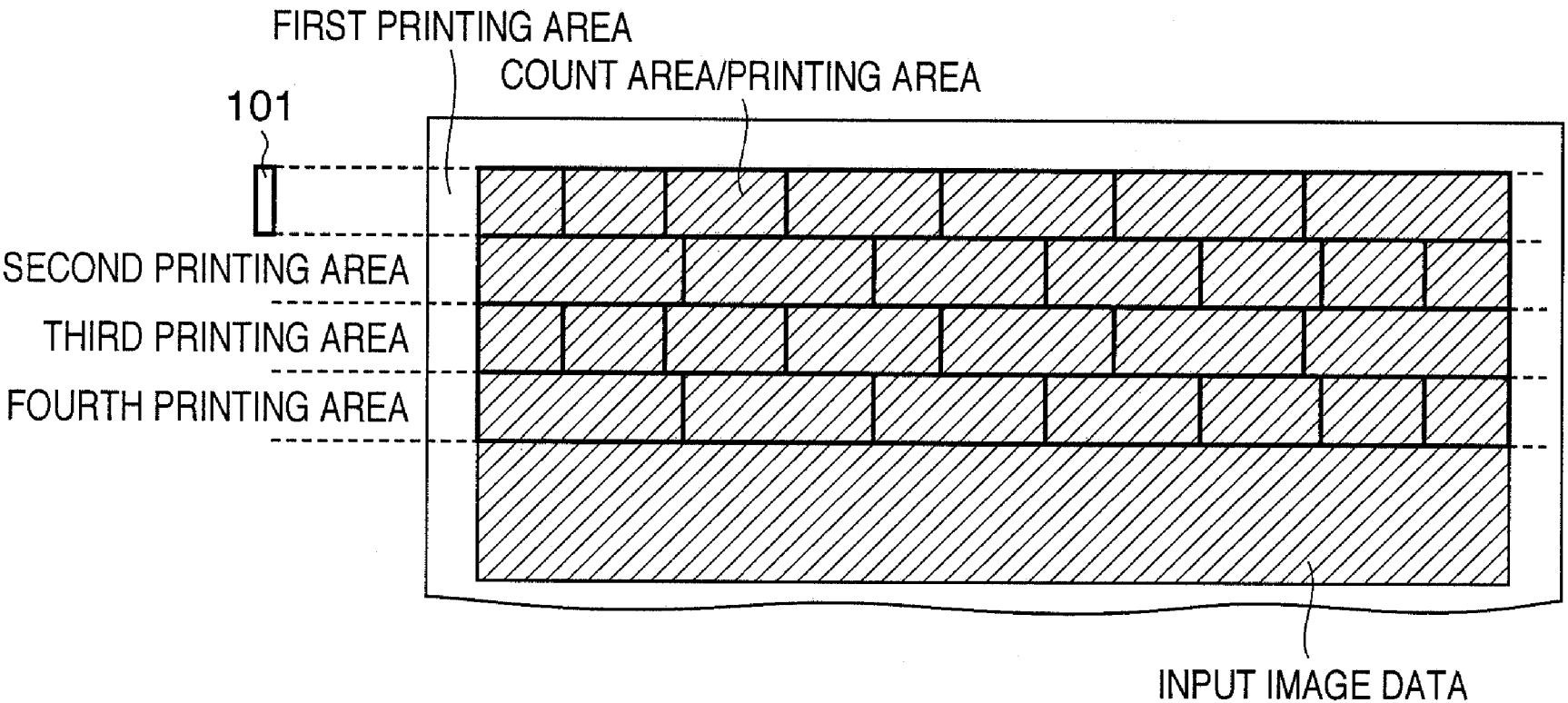
FIG. 20 is a view schematically explaining the divided state of count areas and printing areas in which the numbers of dots of printing data are modified in a case wherein a method of setting different division sizes within a scan is used as a count area dividing method in an embodiment of the present invention.

This embodiment has exemplified the case wherein 20 count areas are set in the horizontal direction. However, it suffices to set the number of count areas to an arbitrary division number in accordance with the temperature rise characteristic of the printhead 101 or the droplet size. For example, as shown in FIG. 19, the division number and size of count areas may be changed for each scan. Alternatively, as shown in FIG. 20, count areas may have different sizes.

Figure 21:
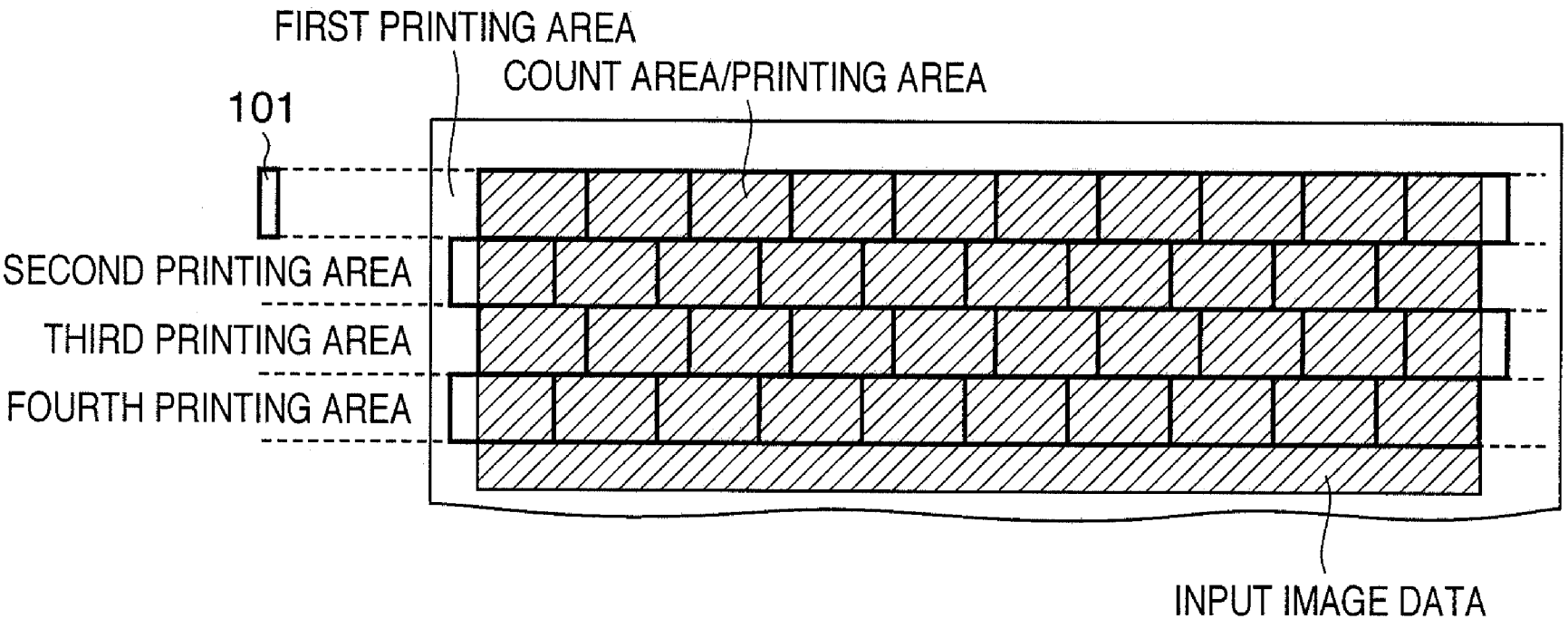
FIG. 21 is a view schematically explaining the divided state of count areas and printing areas in which the numbers of dots of printing data are modified in a case wherein a method of shifting the boundary position between a count area and a printing area for each scan is used as a count area dividing method in an embodiment of the present invention.

In addition, as shown in FIG. 21, even if count areas have the same size, it is possible to set a total size larger than the maximum image size and set the count areas such that the boundary position shifts for each scan.

Figure 22:
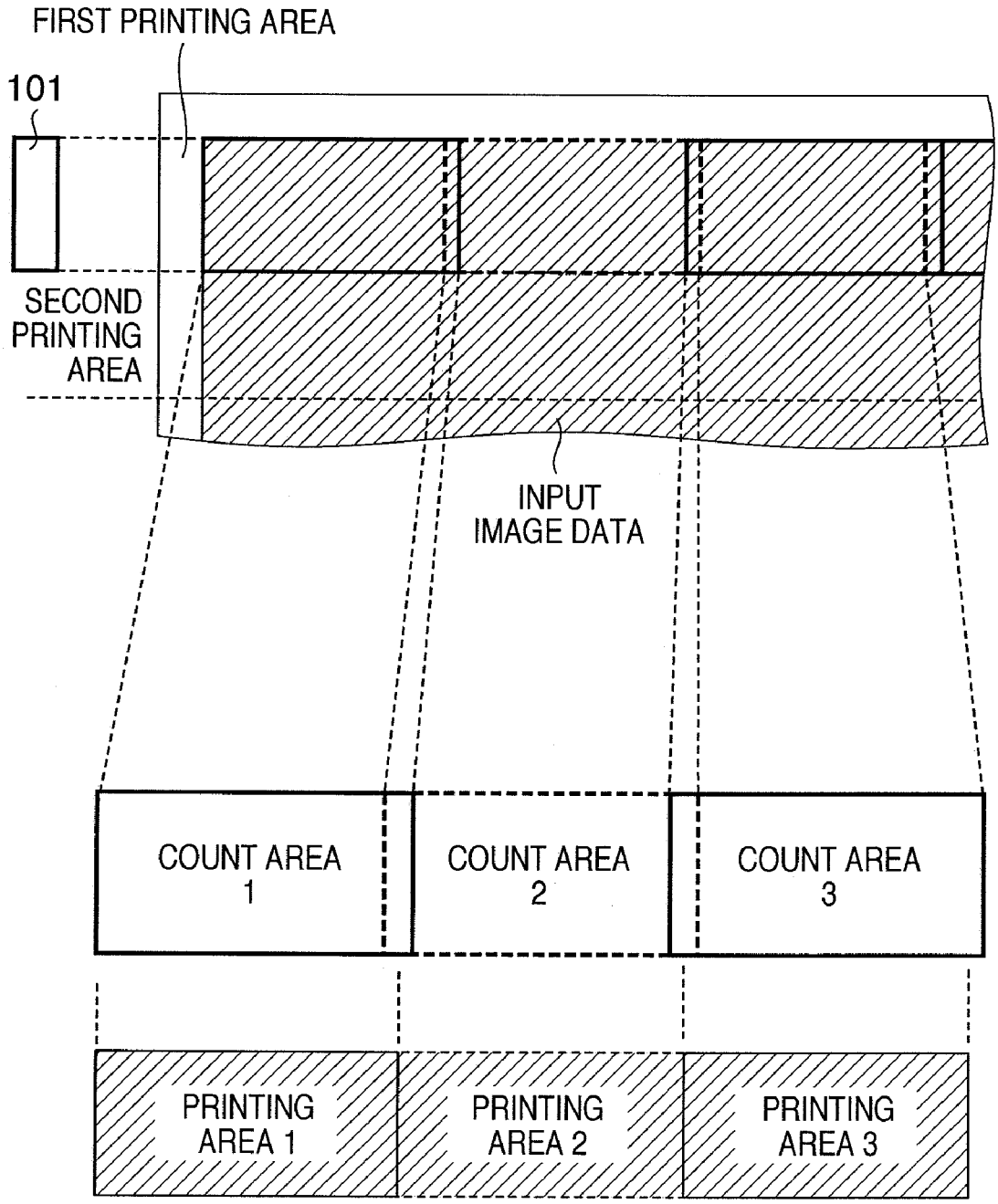
FIG. 22 is a view schematically explaining the divided state of count areas and printing areas in which the numbers of dots of printing data are modified in a case wherein count areas have a size different from that of printing areas in an embodiment of the present invention.

This embodiment has also exemplified the case wherein the size of each count area is equal to that of a corresponding printing area. However, as shown, for example, in FIG. 22, the present invention can be satisfactorily applied even to a case wherein the size of each count area differs from that of a corresponding printing area. In this case, when correcting the image data in a printing area on the basis of the data counted in a count area, the apparatus redundantly performs a correction process for one of the areas. This can improve the correction effect at boundary portions.

Although a technique of modifying the tone value of input multilevel image data as a method for correcting image data has been described in this embodiment, techniques for correcting input multilevel image data of this invention are not limited to this embodiment.

Figure 23A:
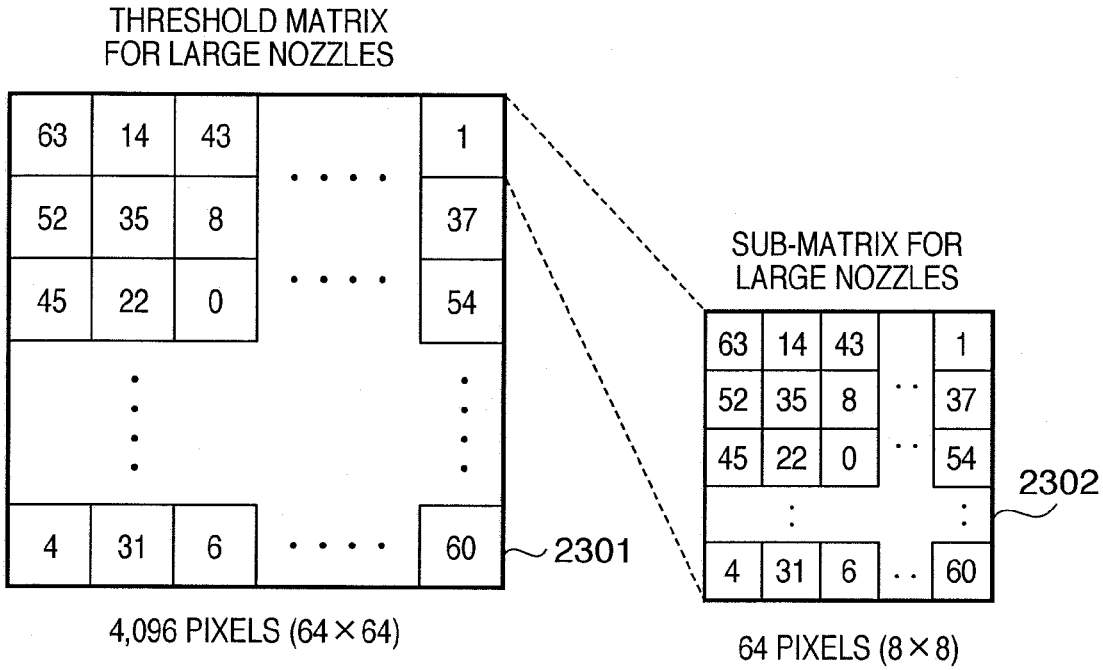
FIGS. 23A and 23B are views schematically showing other threshold matrices used for the correction of printing data in an embodiment of the present invention.
Figure 23B:
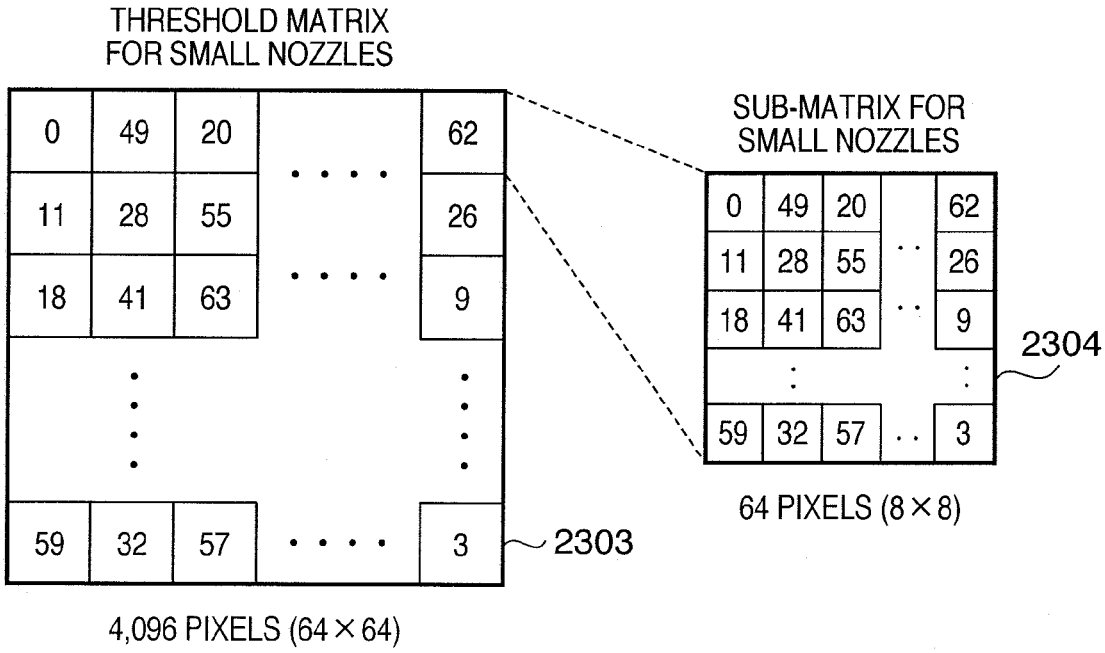

For example, another technique using a threshold matrix as in this embodiment will be described with reference to FIGS. 23A and 23B. Assume that the size of a threshold matrix 2301 for the large nozzles is the same as that for a count area (i.e., 64×64 pixels). A threshold matrix comprises an aggregation of sub-matrices each comprising, for example, 8×8 pixels. Numerical values 0 to 63 are given to each sub-matrix in the threshold matrix, and numerical values 0 to 63 are given to the respective positions in each sub-matrix. This also applies to a threshold matrix 2302 for small nozzles. Referring to FIG. 23, the numerical values in the threshold matrix for large nozzles are reversed with respect to those in the threshold matrix for small nozzles.

In this case, the method of modifying the tone values of input image data performs the processing of decreasing the tone values of input image data corresponding to the respective positions in sub-matrices in accordance with a correction amount in the numerical order of sub-matrices and the numerical order of the respective positions in the sub-matrices. This method sequentially repeats this processing up to a value corresponding to the correction amount. Using such sub-matrices makes it possible to decrease the threshold matrix size itself. This method is therefore effective as a technique for a case wherein importance is attached to the apparatus cost.

Figure 24:
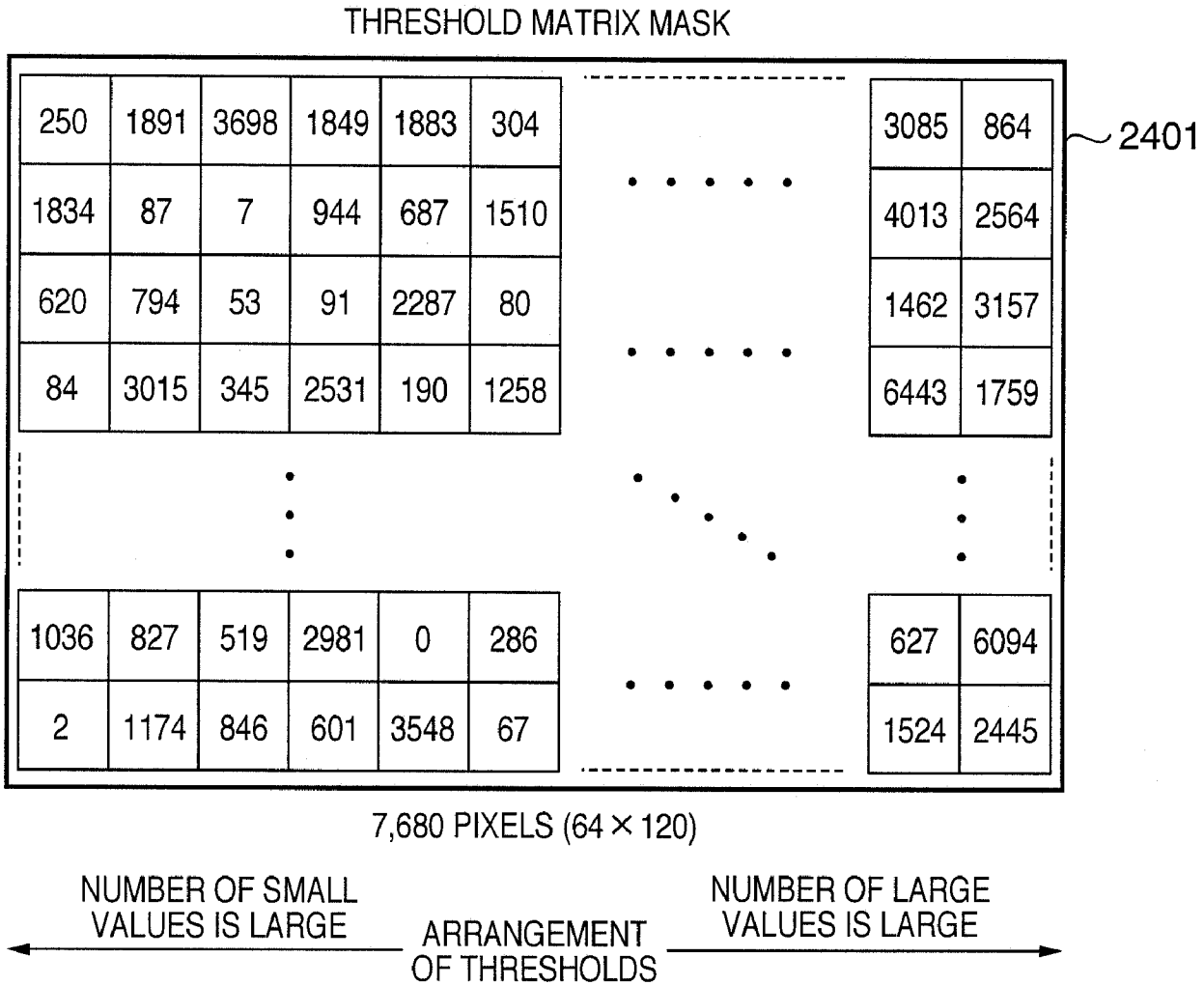
FIG. 24 is a view schematically showing another threshold matrix used for the correction of printing data in an embodiment of the present invention.

In addition, in this embodiment, the numbers of the threshold matrix are allocated such that the variance of all allocations at arbitrary numbers becomes high. As shown in FIG. 24, however, numbers may be allocated such that smaller numbers appear on the forward side in the scanning direction, and larger numbers appear on the backward side in the scanning direction. This technique is effective in reducing abrupt density changes at the boundary portions of count areas especially when the head has a very high tendency toward a rise in temperature.

As another technique of modifying multilevel image data, this embodiment can use, for example, a method of preferentially reducing higher tone values within an area.

Using the correction process for multilevel image data is very effective for photographic image printing which demands high image quality. This embodiment has exemplified the method of calculating a correction amount for image data, which calculates a correction amount on the basis of three kinds of count results, that is, a dot count in a target count area, an accumulated dot count in the horizontal direction, and a total dot count from the start of printing to printing in the immediately preceding scan. However, the apparatus preferably selects an optimal method of calculating a correction amount in consideration of the accuracy of calculation and the apparatus cost.

With regard to the timing of correction, this embodiment has exemplified the method of starting printing operation after executing correction for all printing data corresponding to one main scan. Obviously, the present invention is not limited to this. For example, it is possible to use a method of always processing data corresponding to a plurality of scans in advance or a method of printing in real time by transferring printing data to the head at the same time as the end of correction. That is, it is preferable to use an optimal technique in accordance with conditions such as a printing speed, count area size, and the number of nozzles at the time of printing.

In addition, this embodiment has exemplified the case wherein the printhead 101 prints in the 1-pass printing mode of completing an image by repeatedly performing printing with the total head width and paper feeding. However, the present invention can be applied to the multi-pass printing mode as another printing mode. When the present invention is applied to this multi-pass printing mode, it is preferable to print in the same printing area by overprinting a plurality of times or by calculating a correction amount for printing data in each pass in consideration of conditions such as when the number of dots printed per scan is small.

In addition, the present invention can be applied to an inkjet printing system, comprising a unit (e.g., an electrothermal transducer, laser beam generator, or the like) which generates heat energy as energy utilized for ink discharge. That is, the present invention is very effective for an inkjet printhead and inkjet printing apparatus based on a system which causes a change in the state of ink using heat energy.

As the typical arrangement and principle of the inkjet printing system, one practiced by use of the basic principle disclosed in, for example, U.S. Pat. Nos. 4,723,129 and 4,740,796 is preferable. This system is applicable to either a so-called on-demand type or a continuous type. Particularly, in the case of the on-demand type, the system is effective because it gives a rapid temperature rise exceeding nuclear boiling to each of the electrothermal transducers arranged in correspondence with a sheet or fluid channels holding a liquid (ink), while heat energy is generated by the electrothermal transducer to effect film boiling on the heat acting surface of the printhead; and consequently, a bubble can be formed in the liquid (ink) in one-to-one correspondence with one or more applied driving signals which corresponds to printing information. By discharging the liquid (ink) through a nozzle by growth and shrinkage of the bubble, at least one droplet is formed. If the driving signal is applied as a pulse signal, growth and shrinkage of the bubble can be attained instantly and adequately to achieve discharge of the liquid (ink) with the particularly high responsiveness. As the pulse driving signal, signals disclosed in U.S. Pat. Nos. 4,463,359 and 4,345,262 are suitable. Note that still better printing can be performed by using the conditions described in U.S. Pat. No. 4,313,124, the invention of which relates to the temperature rise rate of the heat acting surface.

As an arrangement of the printhead, in addition to the arrangement as a combination of discharge apertures (nozzles), fluid channels, and electrothermal transducers (linear fluid channels or right angle fluid channels) as disclosed in the above specifications, the arrangement using U.S. Pat. Nos. 4,558,333 and 4,459,600, which has a heat acting portion arranged in a flexed region is also incorporated in the present invention. In addition, the present invention can be effectively applied to an arrangement based on Japanese Patent Laid-Open No. 59-123670 which discloses the arrangement using a slit common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion. That is, the present invention can print reliably and efficiently regardless of the form of a printhead.

Furthermore, the present invention can also be effectively applied to a printhead of the full line type having a length corresponding to the maximum width of a printing medium on which the printing apparatus can print. Such a printhead may have either an arrangement which satisfies its length by a combination of a plurality of printheads or an arrangement as a single printhead which is integrally formed.

The present invention can be applied to a serial type like that described above, a printhead fixed to the apparatus body, or an exchangeable chip type printhead which can be electrically connected to the apparatus body and can receive ink from the apparatus body after being mounted on the apparatus body. In addition, the present invention can be effectively applied to a cartridge type printhead in which an ink tank is integrally provided on the printhead itself. It is preferable to add a recovery unit for the printhead, a preliminary auxiliary unit, and the like provided as components of the printing apparatus of the present invention because the effects of the printing operation can be further stabilized. More specifically, examples of such units include, for the printhead, a capping unit, a cleaning unit, a pressurization or suction unit, a pre-heating unit using electrothermal transducers, another heating element, or a combination thereof, and a preliminary discharge unit which performs discharge independently from printing.

Consider also the type and number of printheads to be mounted. For example, the printing apparatus may have only one printhead in correspondence with monochrome ink or a plurality of printheads in correspondence with a plurality of kinds of inks having different printing colors or densities. In addition to a printing mode which prints images in only a primary color such as blacks the printing apparatus may have either a printing mode using an integral printhead or a printing mode which uses a combination of printheads. Furthermore, the present invention is very effective for an apparatus comprising at least one of a printing mode which prints images in different colors and a printing mode which prints images in full-color as a mixture of colors.

Furthermore, although ink has been described as a liquid in the above embodiment of the present invention, the apparatus may use an ink which solidifies at room temperature or below, and as well as that which softens or liquefies at room temperature. Alternatively, the apparatus may use an ink which liquefies when the print signal is supplied because the inkjet system is generally configured to control the temperature of ink itself within the range from 30° C. or higher to 70° C. or lower so as to make the viscosity of the ink fall within a stable discharge range.

Furthermore, the apparatus may use an ink which solidifies when it is caused to stand, and liquefies when being heated, in order to prevent a temperature rise caused by heat energy by utilizing the temperature rise as energy to cause a state transition from the solid state to the liquid state or to prevent ink evaporation. In any case, the present invention can use an ink which liquefies only after heat energy is applied, for example, an ink which liquefies in accordance with a print signal as a heat energy source so as to be discharged in the form of liquid ink or an ink which begins to solidify when it reaches a printing medium.

In the above case, the ink may be of a type which is held as liquid or solid material in a recess of a porous sheet or a through hole at a position to face the electrothermal transducer as disclosed in Japanese Patent Laid-Open No. 54-56847 or Japanese Patent Laid-Open No. 60-71260. In the present invention, the above film boiling system is most effective for each type of ink described above.

In addition, the inkjet printing apparatus of the present invention is used in the form of an image output terminal of an information processing device such as a computer. In addition, this apparatus may be used in the form of a copying machine combined with a reader, and the like, or a facsimile apparatus having a transmission/reception function.

Second Embodiment

The same conditions as those used in the first embodiment are used for a printhead 101, inkjet printing apparatus, and inkjet printing method used in the second embodiment. As threshold matrix masks for large and small dots, this embodiment uses masks comprising main matrices and sub-matrices like those shown in FIGS. 23A and 23B. The printhead 101 comprises two pairs of nozzle arrays LC, SC, LM, and SM, each nozzle array of which comprises 256 large and small nozzles alternately arrayed at a pitch of 200 dpi (about 21.2 μm), with 128 nozzles being used for a large ink discharge amount and 128 nozzles being used for a small ink discharge amount. Nozzle arrays LY and LBK comprise nozzle arrays for a large ink discharge amount. A printing method based on the 1-pass printing mode and the arrangement of the printing apparatus are the same as those in the first embodiment. In addition, the volume of each ink droplet and a printing material for ink containing a coloring material are the same as those in the first embodiment.

As a method of correcting printing data, this embodiment uses a method of modifying the level of the tone value of multilevel data as in the first embodiment. As shown in FIGS. 23A and 23B, the numerical values in the threshold matrix for large nozzles are reversed with respect to those in the threshold matrix for small nozzles. Therefore, the embodiment designates positions at which image data for large and small nozzles are exclusively and sequentially reduced.

In the second embodiment, a method of modifying the tone values of input image data decreasing, at each level, the tone values of input image data corresponding to the respective positions in sub-matrices in accordance with a correction amount in the numerical order of sub-matrices and the numerical order of the respective positions in the sub-matrices. The method repeats this processing until the tone value becomes equal to the correction amount.

A numerical order in each sub-matrix is determined such that the sequence of reducing multilevel image data for large dots becomes exclusive with respect to the sequence of reducing multilevel image data for small dots. Using a sub-matrix arrangement allows the apparatus to have a simpler arrangement, although the number of types of matrices increases.

Image 1 formed by the above arrangement using the same processing steps as in the first embodiment is free from density differences like those visually recognized on the entire image or density irregularity near the two ends. In addition, it is possible to obtain good image quality without any deterioration in graininess due to local reductions in multilevel image data for large and small dots.

Third Embodiment

The third embodiment can be implemented by using the same arrangement and the same inkjet printing apparatus as those in the second embodiment. The third embodiment reduces dots with respect to image data instead of calculating a correction amount by counting multilevel image data for each ink discharge amount. This makes it possible to reduce image printing data for a small ink discharge amount on the basis of the correction ratio calculated by counting printing data to be printed with nozzles with a large ink discharge amount which causes a large amount of change in density. This allows a reduction in the processing load as compared with a case wherein multilevel image data are counted for all discharge amounts, because printing data for only certain ink discharge amounts are counted. Correcting recording data for a large ink discharge amount allows sufficient correction. In addition, setting the correction ratio of a large ink discharge amount to be equal to the correction ratio of a small ink discharge amount makes it possible to perform correction to some extent. Although inferior to the first embodiment in terms of effect, the third embodiment can obtain good image quality without any density difference which is visually recognizable on an entire image, any density irregularity near the two ends, and any deterioration in graininess due to local reductions in multilevel image data for large and small dots.

Fourth Embodiment

Figure 26A:
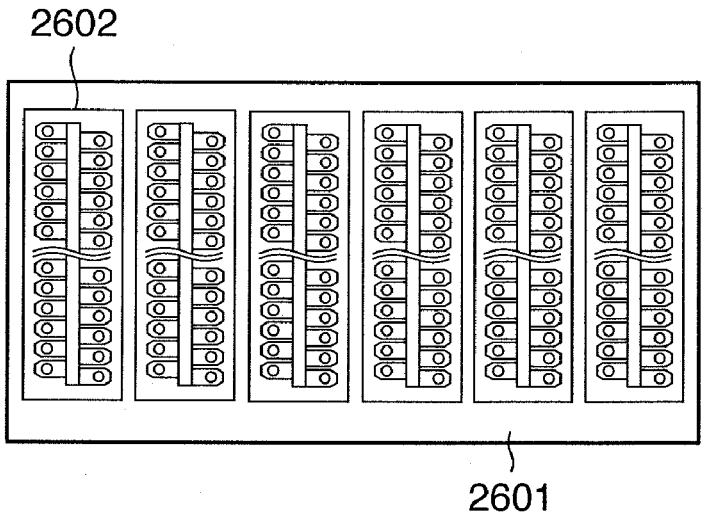
FIGS. 26A and 26B are views for explaining a printhead used in another embodiment of the present invention.
Figure 26B:
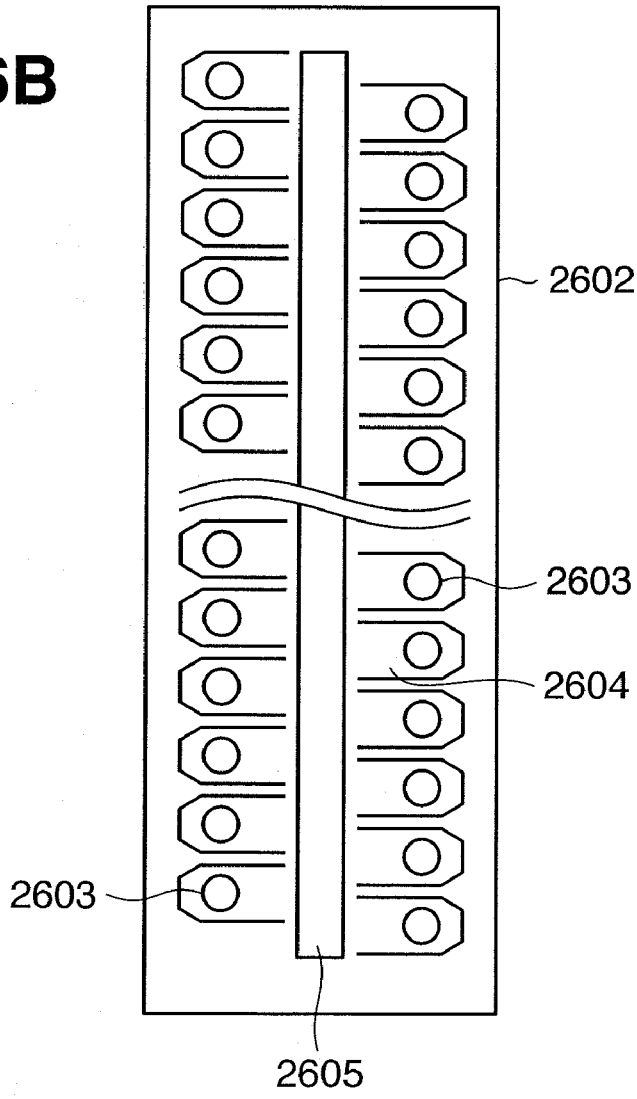

This embodiment prepares inks of similar colors with different densities in place of inks of large and small ink discharge amounts, and uses heads with the same ink discharge amount shown in FIG. 26A and 26B for all the types of inks. A printhead 2601 comprises six pairs of nozzle arrays 2602 each having an array of 256 nozzles. The embodiment sequentially supplies dark cyan (with low lightness), light cyan (with high lightness), yellow, black, light magenta, and dark magenta inks from the left in FIG. 26A. Other arrangements are the same as those of the printhead 101 shown in FIG. 1A. That is, each nozzle array 2602 has nozzles 2603 arrayed on both sides of an ink supply path 2605. Each nozzle can print a dot on printing paper P. Ink is supplied from the ink supply path 2605 through ink flow paths 2064 provided in correspondence with the nozzles 2603.

This embodiment can print a color image on the basis of image data. With regard to the processing in the first embodiment, the fourth embodiment performs processing for printing data with ink having low lightness instead of processing for printing data with a large ink discharge amount, and performs processing for printing data with ink having high lightness instead of processing for printing data with a small ink discharge amount. The fourth embodiment can also obtain good image quality without any density difference which is visually recognizable on an entire image, any density irregularity near the two ends, and any deterioration in graininess due to local reductions in multilevel image data for dots with low lightness and dots with high lightness.

The object of the present invention can be achieved even by supplying a storage medium storing software program codes for implementing the functions of the above embodiments to a system or apparatus. That is, it is obvious that the object of the present invention can be achieved by causing the computer (or a CPU or an MPU) of the system or apparatus to read out and execute the program codes stored in the storage medium. In this case, the program codes themselves read out from the storage medium implement the functions of the above embodiments, and the storage medium storing the program codes constitutes the present invention.

As a storage medium for supplying the program codes, for example, a flexible disk, hard disk, optical disk, magnetooptical disk, CD-ROM, CD-R, magnetic tape, nonvolatile semiconductor memory card, ROM, or the like can be used. In addition, the functions of the above embodiments may be implemented by causing a computer to execute readout programs.

Obviously, the functions of the above embodiments are implemented when the OS (Operating System) or the like running on the computer performs part or all of actual processing on the basis of the instructions of the program codes.

In addition, the program codes read out from the storage medium may be written in the memory of a function expansion board inserted into the computer or a function expansion unit connected to the computer. Obviously, the present invention incorporates a case wherein the functions of the above embodiments are implemented by causing the CPU of the function expansion board or function expansion unit to perform part or all of actual processing on the basis of the instructions of the program codes.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-169380, filed Jun. 19, 2006, which is hereby incorporated by reference herein in its entirety.

What is claimed is:

1. A printing apparatus which prints a dot image on a printing medium by scanning a printhead configured to print a first dot and a second dot smaller than the first dot, the apparatus comprising:

an obtaining unit configured to obtain, for each of areas formed by dividing an area on the printing medium into a plurality of portions, tone value information of first dot multilevel image data corresponding to a plurality of pixels constituting the area and tone value information of second dot multilevel image data corresponding to the plurality of pixels constituting the area; and a correcting unit configured to correct the first dot multilevel image data on the basis of the obtained tone value information of the first dot multilevel image data and to correct the second dot multilevel image data on the basis of the obtained tone value information of the second dot multilevel image data, wherein the correcting unit exclusively determines correction target pixel positions of the first dot multilevel image data and correction target pixel positions of the second dot multilevel image data.

2. The apparatus according to claim 1, wherein the tone value information of the first dot multilevel image data is information concerning a sum of tone values of the first multilevel image data corresponding to the plurality of pixels constituting the area, and the tone value information of the second dot multilevel image data is information concerning a sum of tone values of the second multilevel image data corresponding to the plurality of pixels constituting the area.

3. The apparatus according to claim 1, wherein the correcting unit determines correction target pixel positions of the second dot multilevel image data on the basis of the correction target pixel positions of the first dot multilevel image data.

4. A printing apparatus which prints a dot image on a printing medium by scanning a printhead configured to print a first dot and a second dot higher in lightness than the first dot, the apparatus comprising:

an obtaining unit configured to obtain, for each of areas formed by dividing an area on the printing medium into a plurality of portions, tone value information of first dot multilevel image data corresponding to a plurality of pixels constituting the area and tone value information of second dot multilevel image data corresponding to the plurality of pixels constituting the area; and a correcting unit configured to correct the first dot multilevel image data on the basis of the obtained tone value information of the first dot multilevel image data and to correct the second dot multilevel image data on the basis of the obtained tone value information of the second dot multilevel image data, wherein the correcting unit exclusively determines correction target pixel positions of the first dot multilevel image data and correction target pixel positions of the second dot multilevel image data.

5. A method of controlling a printing apparatus which prints a dot image on a printing medium by scanning a printhead configured to print a first dot and a second dot smaller than the first dot, the method comprising the steps of:

obtaining, for each of areas formed by dividing an area on the printing medium into a plurality of portions, tone value information of first dot multilevel image data corresponding to a plurality of pixels constituting the area and tone value information of second dot multilevel image data corresponding to the plurality of pixels constituting the area; and correcting the first dot multilevel image data on the basis of the obtained tone value information of the first dot multilevel image data and correcting the second dot multilevel image data on the basis of the obtained tone value information of the second dot multilevel image data, wherein the correcting step exclusively determines correction target pixel positions of the first dot multilevel image data and correction target pixel positions of the second dot multilevel image data.

6. A program for causing a computer to execute a procedure of a control method according to claim 5.

7. A computer-readable storage medium storing a program for causing a computer to execute a procedure of a control method according to claim 5.

* * * * *